US010947028B2

(12) United States Patent
Har-Shai et al.

(10) Patent No.: US 10,947,028 B2
(45) Date of Patent: Mar. 16, 2021

(54) PRESSURE MECHANISM FOR SPRAY CANNISTER

(71) Applicant: GreenSpense Ltd., Misgav (IL)

(72) Inventors: Gadi Har-Shai, Hod-HaSharon (IL); Dmitry Golom, Haifa (IL); Steven Arnautoff, Moshav Gan Yoshiya (IL); Nir Lilach, Doar-Na HaAmakim (IL); Eliahu Eliachar, Haifa (IL)

(73) Assignee: GreenSpense Ltd., Misgav (IL)

( * ) Notice: Subject to any disclaimer, the term of this patent is extended or adjusted under 35 U.S.C. 154(b) by 142 days.

(21) Appl. No.: 15/766,012

(22) PCT Filed: Oct. 10, 2016

(86) PCT No.: PCT/IL2016/051106
§ 371 (c)(1),
(2) Date: Apr. 5, 2018

(87) PCT Pub. No.: WO2017/064707
PCT Pub. Date: Apr. 20, 2017

(65) Prior Publication Data

US 2018/0282052 A1 Oct. 4, 2018

Related U.S. Application Data

(60) Provisional application No. 62/384,763, filed on Sep. 8, 2016, provisional application No. 62/290,029, filed
(Continued)

(51) Int. Cl.
*B65D 83/00* (2006.01)

(52) U.S. Cl.
CPC ..... *B65D 83/0061* (2013.01)

(58) Field of Classification Search
CPC ..... B65D 83/0061; B65D 83/14
See application file for complete search history.

(56) References Cited

U.S. PATENT DOCUMENTS 3,961,725 A 6/1976 Clark
4,387,833 A * 6/1983 Venus, Jr. ..... B65D 83/0061 222/95

(Continued)

FOREIGN PATENT DOCUMENTS

| | | |
|---|---|---|
| JP | 59-166264 | 9/1984 |
| JP | 03-022558 | 3/1991 |
| WO | WO 2017/064707 | 4/2017 |

OTHER PUBLICATIONS

International Preliminary Report on Patentability dated Apr. 26, 2018 From the International Bureau of WIPO Re. Application No. PCT/IL2016/051106. (8 Pages).

(Continued)

*Primary Examiner* — P. Macade Nichols

(57) ABSTRACT

A fluid dispensing mechanism for a fluid dispensing device, comprising an elastic sleeve surrounding a bag for filling with fluid for dispensing, the bag having a circumference and being folded at a plurality of folding locations around said circumference, thereby to unfold evenly under said sleeve during a filling process of pressurized filling of said bag with fluid, the mechanism further comprising an anchoring column. The bag is folded around the anchoring column.

21 Claims, 18 Drawing Sheets

Related U.S. Application Data on Feb. 2, 2016, provisional application No. 62/239,913, filed on Oct. 11, 2015.

(56) References Cited

U.S. PATENT DOCUMENTS

| | | | | |
|---|---|---|---|---|
| 4,423,829 | A | 1/1984 | Katz | |
| 4,964,540 | A | 10/1990 | Katz | |
| 5,441,174 | A | 8/1995 | Sperry | |
| 2006/0054634 | A1* | 3/2006 | Mekata | B05B 11/3081 222/94 |
| 2007/0241131 | A1 | 10/2007 | Smith et al. | |

OTHER PUBLICATIONS

International Search Report and the Written Opinion dated Jan. 18, 2017 From the International Searching Authority Re. Application No. PCT/IL2016/051106. (13 Pages).

Communication Pursuant to Article 94(3) EPC dated Nov. 11, 2019 From the European Patent Office Re. Application No. 16790727.8. (5 Pages).

Communication Pursuant to Article 94(3) EPC dated Mar. 22, 2019 From the European Patent Office Re. Application No. 16790727.8. (6 Pages).

Notification of Office Action dated May 14, 2019 From the State Intellectual Property Office of the People's Republic of China Re. Application No. 201680059390.7. (3 Pages).

Translation Dated May 29, 2019 of Notification of Office Action dated May 14, 2019 From the State Intellectual Property Office of the People's Republic of China Re. Application No. 201680059390.7. (2 Pages).

Notification of Office Action and Search Report dated Nov. 23, 2018 From the State Intellectual Property Office of the People's Republic of China Re. Application No. 201680059390.7 and Its Translation of Office Action Into English. (10 Pages).

* cited by examiner

PRESSURE MECHANISM FOR SPRAY CANNISTER

RELATED APPLICATIONS

This application is a National Phase of PCT Patent Application No. PCT/IL2016/051106 having International filing date of Oct. 10, 2016, which claims the benefit of priority under 35 USC § 119(e) of U.S. Provisional Patent Application No. 62/239,913 filed on Oct. 11, 2015, U.S. Provisional Patent Application No. 62/290,029 filed on Feb. 2, 2016 and U.S. Provisional Application No. 62/384,763 filed on Sep. 8, 2016.

The contents of the above applications are all incorporated by reference as if fully set forth herein in their entirety.

FIELD AND BACKGROUND OF THE INVENTION

The present invention, in some embodiments thereof, relates to a pressure mechanism for pressurized dispensing for example as an aerosol, or using a spray canister and, more particularly, but not exclusively, to such a pressure mechanism for a spray canister that does not rely on propellant.

Instead of propellant, the canister may rely on an inner bag that contains the formulation (material to be dispensed), and which is surrounded by a pressure sleeve. The elastic sleeve may provide an uninterrupted flow of material under pressure.

There are four types of inner bags currently in use in Dual Compartment continuous dispensers, three using a propellant and one using an elastic sleeve, as follows:

Bag On Valve (BOV) (e.g., Lindal Group GmbH, Germany; Coster Group, Italy; Summit Packaging Systems, USA; Precision, USA; and others)—a laminated and flexible material bag that is welded to the valve assembly of the dispensing device. The bag is designed to operate in a gas (propellant) environment (mainly compressed air and nitrogen) and therefore has no limitations on shape, sharp edges and symmetry. The bag is created by welding the contour of two sheets together and in most cases has full barrier properties because of aluminum foil in the laminate. However, being welded causes the bag to be weaker and have less resistance to mechanical stresses. The empty and flat BOV is folded in a round shape around its axes, i.e. the folding creates 2 'wings' which open up to a rounded bag shape. The propellant is inserted into the canister between the bag and canister walls, either through the valve or under the valve's cup.

Bag In Can (BIC) (e.g., Crown Holdings, Canada)—an inner fully opened pouch made of nylon which is mechanically secured between the canister and the valve housing. The pouch has low barrier properties and therefore is designed to work only with LPG propellants that have larger molecules size than the barrier. The pouch is first filled and then secured and sealed with the valve attached to it and the canister. The propellant is inserted into the canister through a hole (Nicolson method) in the bottom of the canister which makes filling more complex.

Power Pouch (e.g., Power Container, USA)—an inner pouch designed to work with an elastic sleeve mounted over it. The pouch has the shape of a star when empty and opens up to a cylindrical pouch when filled with material. The star shaping of the bag eases the opening process in contrast to BOV bags. However the bag is made of thin PET material which provides medium barrier properties unable to withstand some material formulations and because of its material is less resistance to mechanical stresses.

Piston Barrier package—(Airopack, Switzerland and others)—a PET cylindrical canister that is divided into two chambers by a movable piston. The upper chamber contains the material to be dispensed and the lower chamber contains propellant (LPG or air). The propellant pushes up the piston that separates between the chambers and as a result material is dispensed when the valve is released. The Propellant is inserted through a hole in the bottom of the canister (Nicolson method) which makes filling more complex.

International patent application no. IL2012/050063 filed on Mar. 1, 2012, discloses a pressurized fluid dispenser that does not use propellant, rendering it safer for use, transport and storage, than existing propellant based devices which are liable in some cases to explode or become flammable if exposed to heat, or are ruptured or punctured. Furthermore, LPG propellants (i.e. Butane, Propane, etc) harm the atmosphere if released, contributing to the Green House Effect. Instead of propellants, an elastic sleeve compresses a bag, when the bag is full of material thus stretching the sleeve. The bag is connected to a dispensing valve. The bag is filled or partially filled with a liquid or paste or foam or mixture or other fluidly deliverable substance, or a powder, which is the material to be dispensed. Pressure from the sleeve pressurizes material in the bag, which consequently flows out of the bag under pressure when the valve is opened.

FIG. 1 shows an earlier bag. The bag is wrapped around and reference numeral 10 shows the rolled up bag which is connected to user-operated dispensing valve 12. An elastic sleeve 14 which comprises a lumen, is fitted over the bag, say using mounting machine 16 so that the sleeve contains the bag within the lumen. Reference numeral 18 shows the sleeve fitted over the bag while the bag is wrapped. The bag is then filled using filling machine 20. In FIG. 2, the empty sleeve is given reference numeral 21. The rolled bag 10 is again shown. The sleeve fitted on the bag is shown at 24. The filled bag under the sleeve is shown at 26, and 28 illustrates the mechanism installed in an external package. The sleeve and the bag are sized and positioned so that elastic contraction forces in the sleeve exert compressive pressure on the bag even when the bag is empty.

As shown with reference numeral 10, the bag is rolled, forming a single lobe. A problem arises in that the upon being filled, the bag has to unwrap in order both to expand and to push out the sleeve, and damage often occurs to the bag and the elastic sleeve during the filling process, leading to failure of either the bag, the sleeve or both. Reasons for the failure include the following:

1. High mechanical forces on the bag during filling are created because the need of the bag to inflate while being restrained by the sleeve may lead to tearing of the bag;
2. Sharp edges of the bag and sharp edges that are created on the squeezed bag may cause pin hole bursts of the bag and/or tearing of the sleeve;
3. Welded laminates become weaker at the line between the welded part and the un-welded part causing the bag to fail at the line; and
4. Because the bag has to unwind itself, in many cases the unwinding is not perfect, creating uneven inflation which is not good which may disrupt the balance of forces on the bag.

SUMMARY OF THE INVENTION

In the present embodiments a central anchoring column is provided. The bag is folded at multiple fold points around its circumference so as to unfold evenly under the sleeve during filling by opening each of the folds. Thus there is provided a fluid dispensing mechanism, suitable for an aerosol can or like fluid dispenser, which does not use propellant gas but rather comprises an elastic sleeve surrounding the bag that is filled with fluid, paste or foam or like material for dispensing. The bag is initially folded to provide overlapping folds prior to filling at a plurality of folding locations around its circumference, and when filled under pressure while located under the sleeve, unfolds evenly by opening the overlapping folds together. Thus the bag does not tear or strain during the filling process. Furthermore in certain embodiments, there are no welds and no aluminum foil is required. In other embodiments welding is used and the bag is welded onto a central anchoring column.

The present embodiments further relate to a direct mechanical connection between the pressurized bag and the dispensing valve.

In one embodiment, an anchoring column may be provided around which the bag is initially folded, and one of the column may be provided with a cavity to host the valve's spring which in the current art is hosted by a separate spring housing.

The bag of the present embodiments may have high barrier properties to prevent diffusion, particularly during long term storage. In addition, the flexible material used for making the bag may be modified or replaced to suit different material formulations to be dispensed.

According to an aspect of some embodiments of the present invention there is provided a fluid dispensing mechanism for a fluid dispensing device, comprising an elastic sleeve surrounding a bag for filling with fluid for dispensing, the bag having a circumference and being folded with overlapping folds at a plurality of folding locations around said circumference, thereby to unfold evenly under said sleeve during a filling process of pressurized filling of said bag with fluid.

In an embodiment, said plurality of folding locations are at regular intervals around said bag circumference.

In an embodiment, said plurality of folding locations are symmetrically arranged around said circumference.

In an embodiment, folds at said folding locations are three layer folds or even more.

An embodiment may comprise an anchoring column, said bag being folded around said anchoring column.

In an embodiment, said bag is heat welded at two anchoring locations, the anchoring locations being one member of the group comprising: shaped with teeth and smooth.

In an embodiment, wherein said bag is heat welded at two anchoring locations, the anchoring locations having an outer shape being one member of the group comprising: rounded, flattened, oval shaped, diamond shaped, and rhombic.

The outlet valve may be operated by a spring. The spring may be housed in the anchoring column. The bag may be welded onto the column on the outside over the location housing the spring.

The bag may have an upper end and a lower end, and both said lower end and said upper end may be fixedly attached to said anchoring column.

In an embodiment, said sleeve has an upper end, said sleeve ends being slidable along a housing of a holding part of said anchoring column, said upper holding part being connected to a user-operable valve for dispensing said fluid.

In an embodiment, said bag comprises a plurality of laminated layers.

In an embodiment, said elastic sleeve is of sufficient strength to press said bag against said column until said bag is emptied of said fluid to be dispensed.

Embodiments may use an anchoring column, said bag being folded around said anchoring column, and the anchoring column being hollow and connected to an outlet pipe that leads to an aerosol dispensing valve, to provide an outlet path.

In an embodiment, said bag is welded to said anchoring column. Alternatives include gluing and mechanical attachment.

In an embodiment, said anchoring column comprises a reservoir of foaming agent.

An embodiment may use a plurality of bags connected in series or in parallel.

According to a second aspect of the present invention there is provided a method of manufacturing a fluid dispenser comprising:

providing a bag having a height and a bag circumference;

providing an anchoring column having a column circumference smaller than unfolded said bag circumference;

connecting an upper end of said column to a dispensing valve;

folding said bag with overlapping folds at a plurality of folding locations to reduce said bag circumference to substantially equal said column circumference;

placing said bag on said column; and fitting an elastic sleeve over said folded bag, such that on filling said bag, said bag unfolds under said sleeve evenly by opening folds at said plurality of folding locations.

The method may comprise filling said bag and causing said bag to unfold under said sleeve by opening each of said plurality of folds.

The method may comprise clamping said bag at said upper end and at said lower end under upper and lower holders respectively.

The method may comprise welding said bag at said upper end and at said lower end.

The method may comprise locating at least one end of said elastic sleeve slidably on said column and bag.

The method may comprise placing washers between said column and said upper and lower holders respectively.

In an embodiment, said bag is a laminated bag.

The bag may have four or more folding locations.

The method may comprise folding said bag into three layers at each of said folding locations.

According to a third aspect of the present invention there is provided a fluid dispensing mechanism for a fluid dispensing device, comprising an outer compartment with a pressurized propellant surrounding a bag for filling with fluid for dispensing, the bag having a circumference and being folded with overlapping folds at a plurality of folding locations around said circumference, thereby to unfold evenly within said outer compartment during a filling process of pressurized filling of said bag with fluid.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
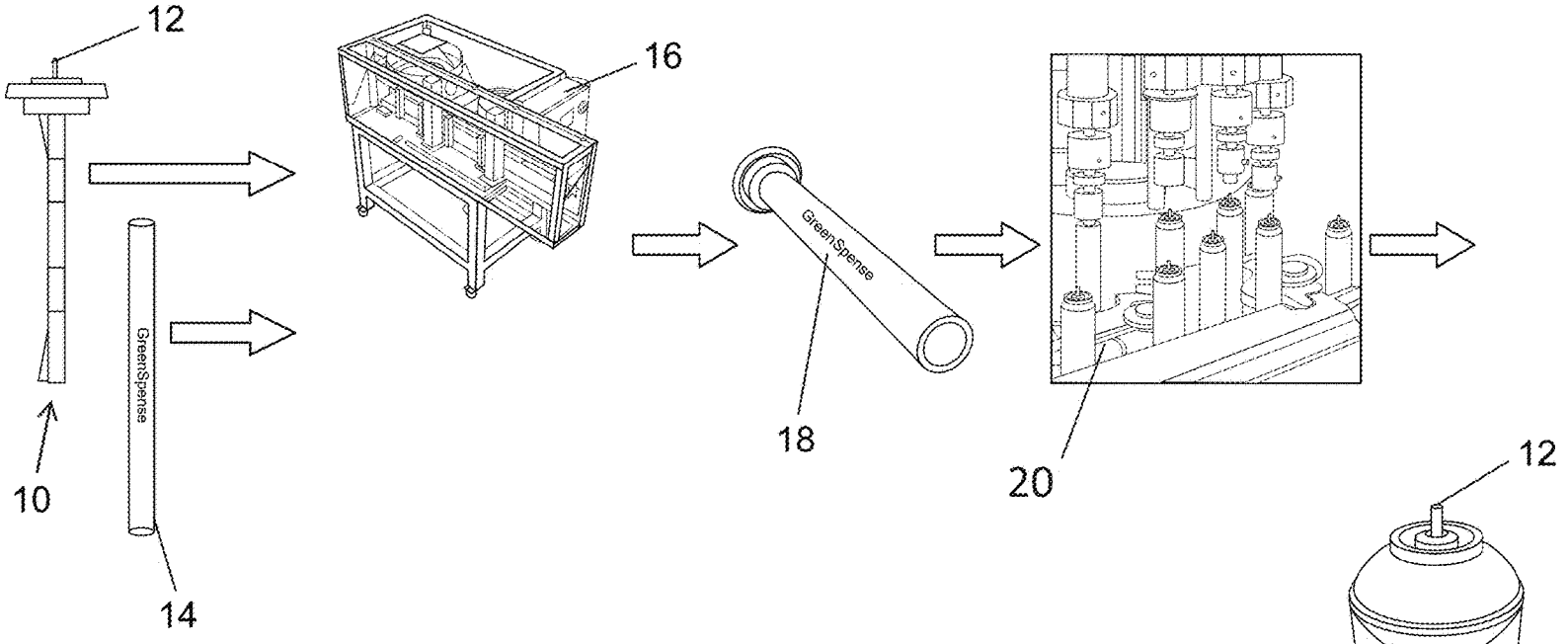
FIG. 1 is a simplified diagram showing the process of constructing a prior art elastic sleeve-based dispensing device.

The present invention, in some embodiments thereof, relates to an inner bag of a Single Compartment device for dispensing materials under pressure which does not utilize a propellant gas. Rather the device comprises an inner bag attached to a valve, containing dispensable material and a stretched elastic sleeve mounted over the inner bag for compressing the bag.

The inner bag may be flexible and may be especially designed for sleeve operation, that is for placement within an elastic sleeve. The bag may consist of a flexible part that is connected to holders of the dispensing device; the bag holder as further described herein. The bag may be constructed of a laminated or co-extruded material that is made of multiple layers, for example three, five, seven, nine layers etc. and the materials of the various layers may be selected to optimize the bag for the characteristics needed when placed under an elastic sleeve. The bag may be sufficiently flexible to fit the sleeve and thus obtain support from the sleeve against the high pressure that is built up inside the bag as a result of the sleeve itself. The idea is to approach zero net force on the various parts of the bag or in other words that force balance is directly between the elastic sleeve and the material to be dispensed and there are no tangential forces. It is added that although the bag is intended not to experience forces, it may still be made strong enough to withstand considerable force.

The bag may provide a high barrier to prevent gases and liquids from entering and/or combining with the material inside the bag. The barrier may be provided by using a metalized layer or a layer like ethylene vinyl alcohol (EVOH), which is a layer of plastic resin that provides good resistance to oxygen and water vapor. The plastic resin is commonly used as an oxygen and water vapor barrier in packaging of food and medicine, and is better than other plastics at keeping air out and flavors in and water vapor getting out and by that drying the content, and can be made to be highly transparent, weather resistant, oil and solvent resistant, flexible, moldable, recyclable, and even printable. As well as preventing oxidation and drying, the bag may further be required to protect the elastic sleeve from harmful material in the contents of the bag. A layer of inert PE or PP may be used to prevent reaction between the material inside the bag and the bag. Being strong, by reinforcing the bag with other layers enables the bag to withstand high mechanical forces that builds up during filling and dispensing. The strength of the bag may also be used to retain a maximum desired diameter because if not, the sleeve may be stretched by the bag without limit and tear. For example a bag with diameter of 40 mm may be used with sleeves that can stretch up to 450-500% and a bag with a diameter of 50 mm may be used with sleeves that can stretch 550-600%. Other configurations may be used in terms of more layers and with different types of characteristics.

Moreover the bag may be designed to open up symmetrically when filled, may have no sharp edges and welded areas should either be absent or may be designed to ensure that they are not liable to weaken the material comprising the folded bag, to the point of making the bag prone to rupture or tearing.

The elastic sleeve is fitted over the bag, with the bag and sleeve being sized and positioned relative to each other such that the contracting sleeve exerts pressure on material contained in the bag, causing the material to flow out of the bag when the dispenser valve is opened.

Thus, according to some embodiments of the present invention, there is provided a bag assembly for dispensing a material under pressure, comprising:

(a) a flexible bag for containing the dispensable material;

(b) an elastic sleeve which is fitted and stretched over the bag, the sleeve and bag being sized and positioned relative to one another so that elastic contraction of the sleeve compresses the bag even when it is empty;

(c) a bag holder to which the bag is attached and sealed at each end, i.e. top and bottom ends, where the upper end of the assembly, i.e., the bag holder, is attached to a valve operable to control release, i.e. dispensing of material contained in the bag; and (d) a passage between the valve and inner side of the inner bag to deliver the material both for filling and for dispensing.

In general, the sleeve is characterized as being sized and shaped to contain the inner bag and to compress the bag when it is filled at least partly with material. The sleeve generates pressure on the bag even when the bag is empty due to the anchoring rod diameter being larger than the sleeve's lumen, thus ensuring pressure up to the last drop.

The elastic sleeve may be comprised of a compound that comprises rubber, nano-particles and other ingredients.

The bag may be made of laminated material or produced in a co-extrusion process or any other method that generates a bag with high barrier properties, and which enables the properties of the bag to be designed for improved strength, and flexibility. In particular, the bag is accorded a high oxygen and liquid barrier depending on the material to be delivered and pressure requirements. The bag may, in embodiments, be constructed without any necessity for welding, and therefore the bag avoids having weak points and thus may be stronger and sounder as aforesaid. Thus, the fabrication process is in contrast to that of similar types of bags which are put or welded together by heat all around, which weakens the bag making it prone to tearing or rupture.

The bag of the present embodiments may be folded at multiple folding points before being fitted under the sleeve and prior to being filled. Each fold may be part of a Z shape so that the full diameter is squeezed to a ⅓ of the diameter at the empty position, from which the bag is able to open out evenly under the sleeve during filling. The inner core diameter is calculated to accept a whole number of Z folds.

For example if using a 40 mm diameter bag than the folded diameter may be 40/3=13.3. The circumference of 13.3 diameter is 13.3×3.14=41.89. The closest whole number of folds is 6.

The folds may be constructed using a device that generates force and/or heat to create each and every fold until the sheet forming the bag is folded. The folds may be formed on a sleeved material or on a sheet of the flexible material. In the case of sheets it may be necessary to add a weld to connect both ends of the sheet to create a sleeved shape, however the weld is a single line and not a weld all around the circumference, by contrast with current BOV's. In another embodiment creation of the bag shape may be brought about by connecting the two ends of a laminated sheet to create a cylindrical shape. Moreover a bag with cylindrical shape and one or more diameters may be used.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 2:
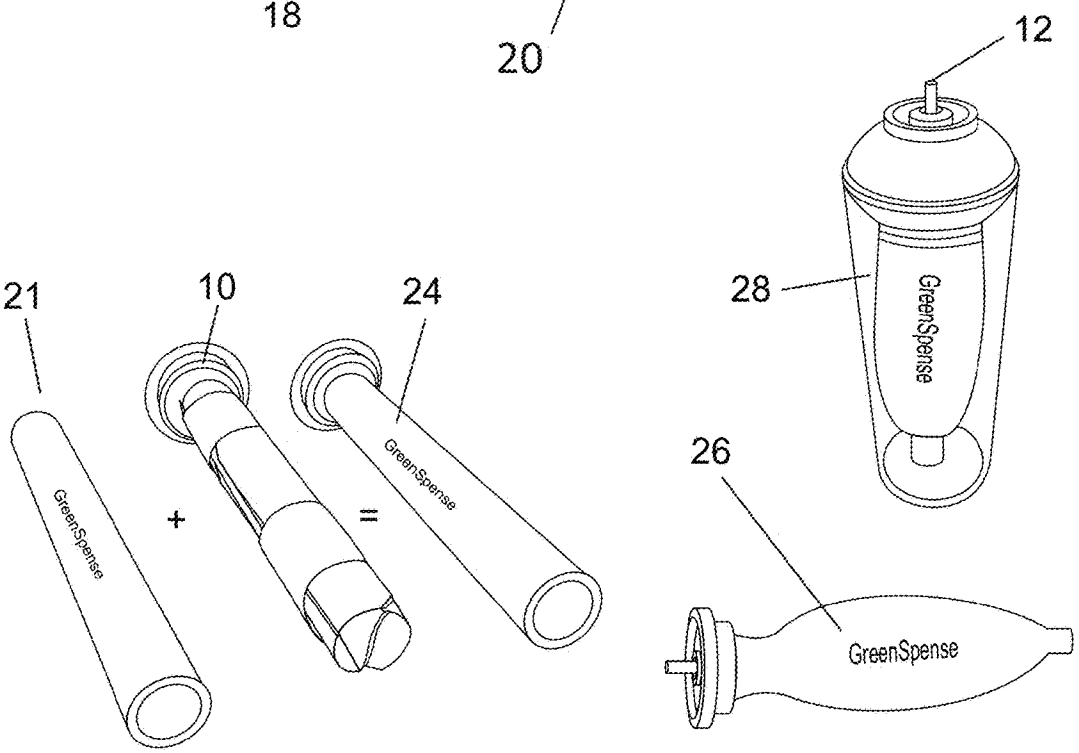
FIG. 2 shows a series of photographs of successive stages of the construction process of FIG. 1.

It is noted that the prior art, as shown in FIGS. 1 and 2 have no central rod.

Figure 3B:
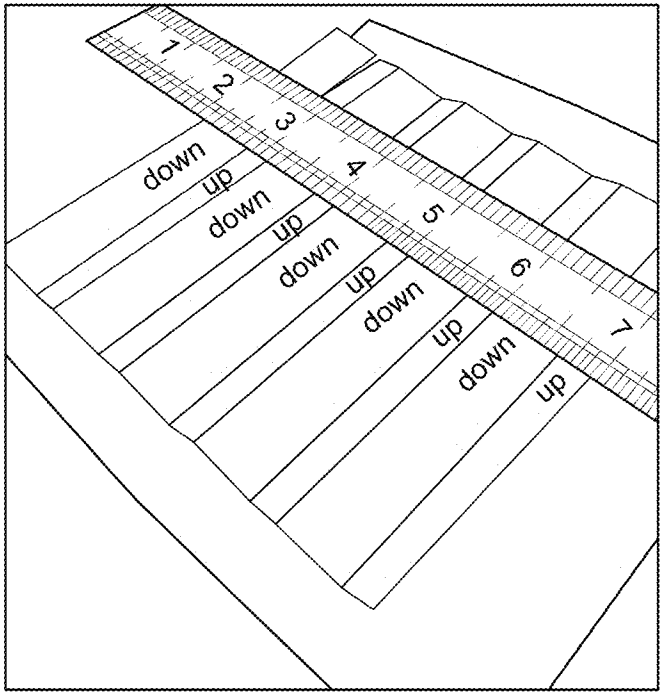
FIG. 3B is a photograph of laminate preparation for folding.
Figure 3C:
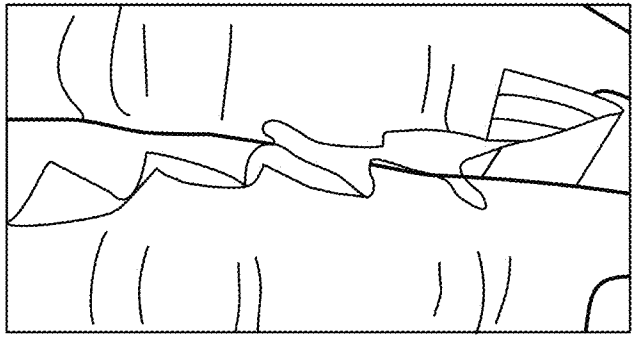
FIG. 3C illustrates bag folding according to an embodiment of the present invention.
Figure 3A:
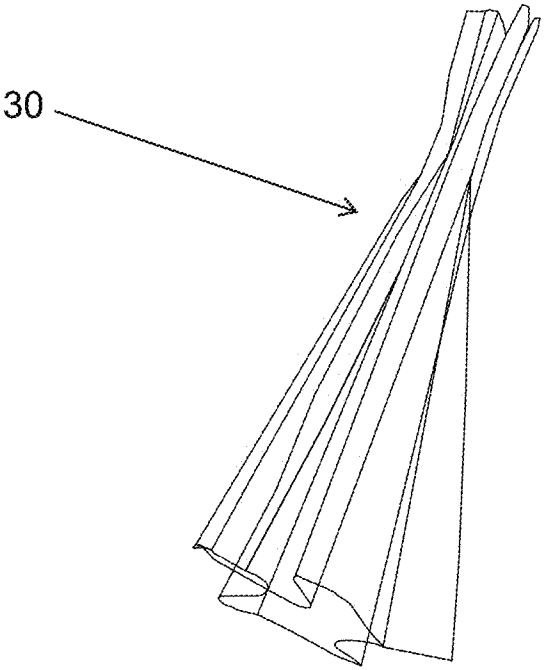
FIG. 3A is a photograph of a folded bag before being assembled on holders.

Referring now to the drawings, FIG. 3A illustrates an inner bag 30 according to the present embodiments for use in a fluid dispensing mechanism. The bag is folded at multiple locations around the circumference of the bag so as to unfold evenly under an elastic sleeve when filled with fluid during a pressurized filling process.

As shown in FIGS. 3B and 3C, the folds are distributed evenly around the bag circumference. The distribution may be symmetric and alternate folds are up and down to make a series of 'z' shaped structures or three layer folds in the bag. As mentioned above, the bag may include laminated layers and different layers may be selected for their barrier properties against oxygen, water, the substance to be dispensed, and for mechanical properties. FIG. 3A is a photograph showing the folded laminate before being assembled on holders. When the folded sheet is connected to the bag holder, it forms a bag, i.e. once it has been folded, secured and sealed by the bag holder.

The bag may be made of flexible bag material. In one embodiment the bag may be flexible, and in another embodiment the bag may be both flexible and stretchable. As discussed above the stretchability may be limited. In the latter case the bag may be inflated during filling to achieve a balloon-like effect. The bag may comprise a single layer or multiple layers, and the layers may or may not include barrier layers such as layers of EVOH, PVDC, Metallic layers, ALD etc.

Figure 4C:
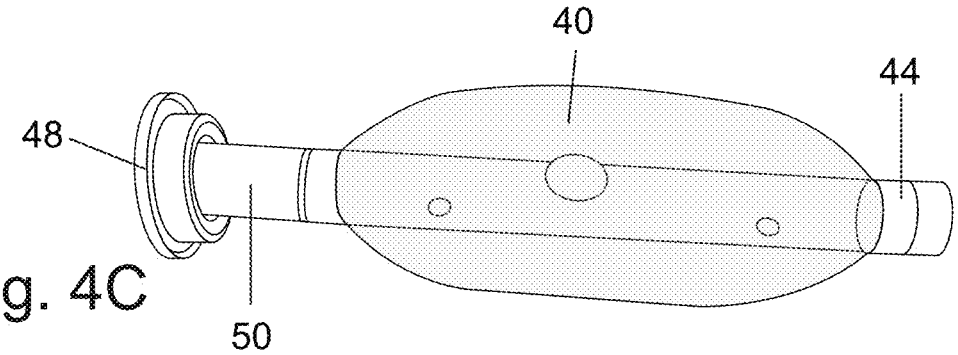
FIGS. 4A-4C are an exemplary inner bag according to an embodiment of the invention, in empty, semi-filled and filled states respectively.
Figure 4B:
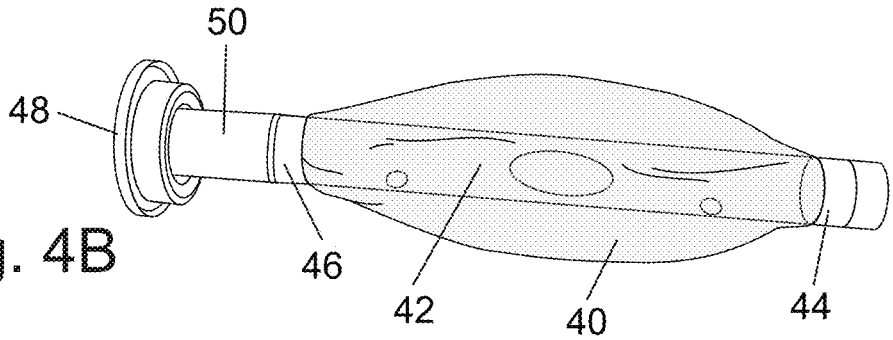
Figure 4A:
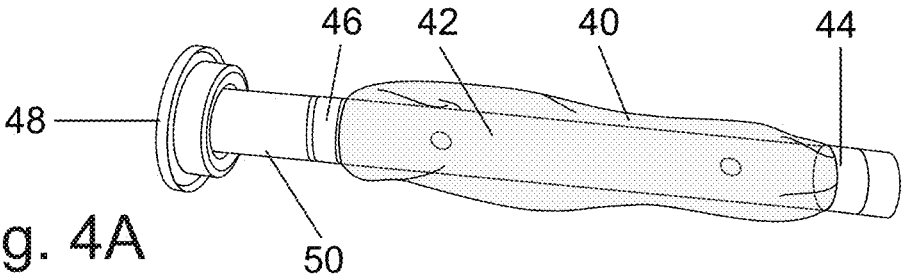

Reference is now made to FIGS. 4A, 4B and 4C. As shown in FIG. 4A, once folded, the bag 40 is inserted in folded form over an anchoring column 42 and the top and bottom of the bag respectively are inserted into conical holding rings 44 and 46. The dispensing column is connected to dispensing valve 48 and top holding structure 50. The top holding structure surface 50 allows for the elastic sleeve to stretch freely during inflation of the bag, as will be explained in greater detail below. FIG. 4A shows the bag empty and fully folded. FIG. 4B shows the bag partly filled and beginning to unfold, albeit without an elastic sleeve. The elastic sleeve is left out for illustrative purposes, and FIG. 4C shows the bag completely filled and fully unfolded, again without the elastic sleeve.

Typically, when placed on the column, the folds are in parallel with the lengthwise direction of the column. However it is also possible to mount the bag in such a way as to make the folds twist around the column to varying extents.

When filled with material, e.g. liquids, foam, gel, pastes, or other viscous material, the bag opens like an elongated balloon, symmetrically around the axis defined by anchoring column 42 without sharp edges, welded seams or other potentially weak points.

Figure 5:
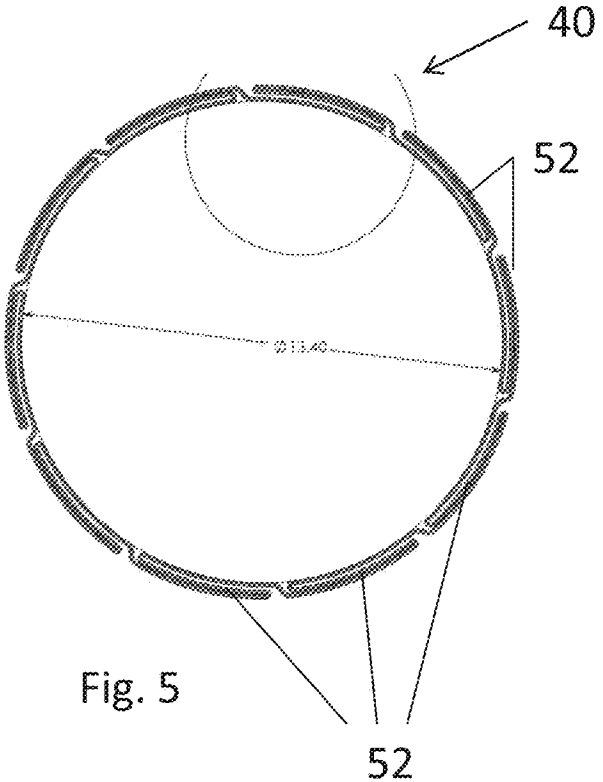
FIG. 5 is a simplified schematic cross-section of an inner bag having three folds and shown prior to filling and expansion, according to an embodiment of the present invention.

Reference is now made to FIG. 5, which is a cross section showing the bag 40 in the folded state of FIG. 4A. The bag is folded at regular intervals around the circumference into multiple z-shaped, or overlapping, folds. In the illustration, ten such folds are shown, allowing a symmetric distribution around the circumference. The number ten is only an example and the number may be selected depending on the bag diameter and initial pressure desired. The number of Z folds is to be distinguished from the number of folds made in the bag, which may be three times the number of Z folds.

In more detail, FIG. 5 provides a cross sectional sketch of the bag 40 schematically showing Z-folds 52 around its circumference. The folded bag for example may be +/− 13 mm in diameter and when filled with material may open up to its original size of +/− 40 mm diameter or may be +/− 16.7 mm in diameter and when filled with material may open up to its original size of +/− 50 mm diameter. The laminated sheet is folded symmetrically as explained above when forming the bag to fit around the anchoring column 42. Each fold comprises three layers of material, creating a flat Z shape, as for example indicated by reference numeral 52. The folding allows the flexible bag to fit in compact form around the anchor column 42 ready for filling and when empty, to enable fitting of the elastic sleeve over it. The bag then opens up symmetrically within the elastic sleeve when filled with material to reach its original diameter.

If for example the diameter of the fully extended bag is about 40 mm, its diameter after folding in multiple Z-folds around the column would be about 40÷3., i.e. about 13.3 mm or if the diameter of the fully extended bag is about 50 mm, its diameter after folding in multiple Z-folds around the column would be about 50÷3., i.e. about 16.7 mm. The number of Z-folds around the column may vary. An exemplary number of folds according to one embodiment of the invention is 5. A further exemplary number of folds according to an embodiment of the invention is 7. Moreover a double Z fold is possible for bags to allow them to open up 6 times the initial (empty) diameter. A diameter of the bag may be between 20-70 mm, for example, 40 mm, 50 mm, or 60 mm.

The length of the bag may be between 10 mm and 500 mm, for example, for personal care products the length of the bag assembly may be 160 mm, 200-250 mm for technical products, and pharmaceutical or cosmetic products, e.g. 50 mm, 100 mm.

Figure 6:
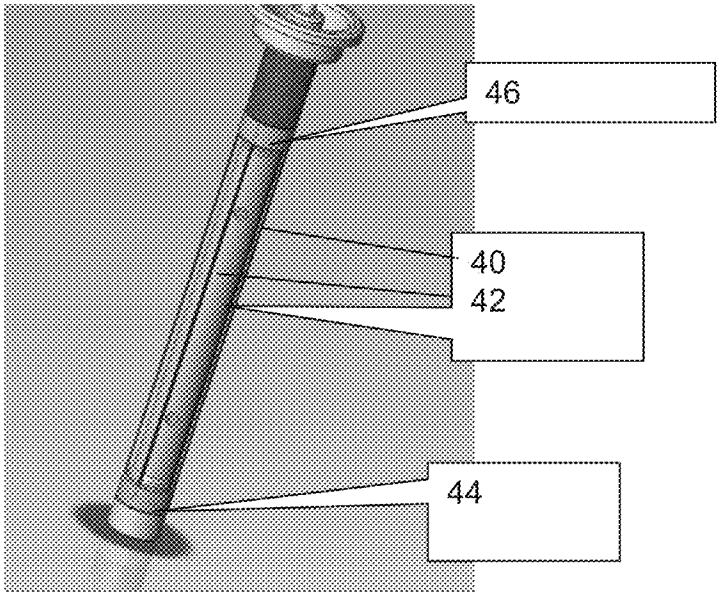
FIG. 6 is a simplified schematic diagram of a bag holder assembled on an anchoring column, according to an embodiment of the present invention.

Reference is now made to FIG. 6, which is a perspective view of the bag 40 in the folded state of FIG. 4A and attached to anchoring column 42. The lower end of the bag is attached at ring 44 and the upper end at ring 46. More particularly, the Z-shape folded bag laminate is secured mechanically and sealed to the bag holders 44 and 46. In one embodiment of the invention, the laminate is secured by locking the conical metal rings 44 and 46 over the bag, against a conical area of the holder column, that is an inner rigid column part of the bag assembly, and the parts are mechanically forced together by tightening a nut. In other embodiments the bag may be welded to the column, in particular at the top end where it can be welded to the lower side of the valve.

Other methods of securing the laminate to the bag holder e.g. using plastic parts, are envisioned and include alternatively folding the folded flexible material ends into hollow ends of the main column and then securing and sealing by forcing plugs into those hollows. Another option is using two metal bands to secure and seal both ends of the flexible material to the main column. Another option is to use glue, heat welding and or combination of all of the above to secure and seal the flexible material ends to the main rigid column, and other methods will occur to the person skilled in the art. Another option is an over molding technique which involves attaching the bag to the column in the injection mold of the column.

Figure 7:
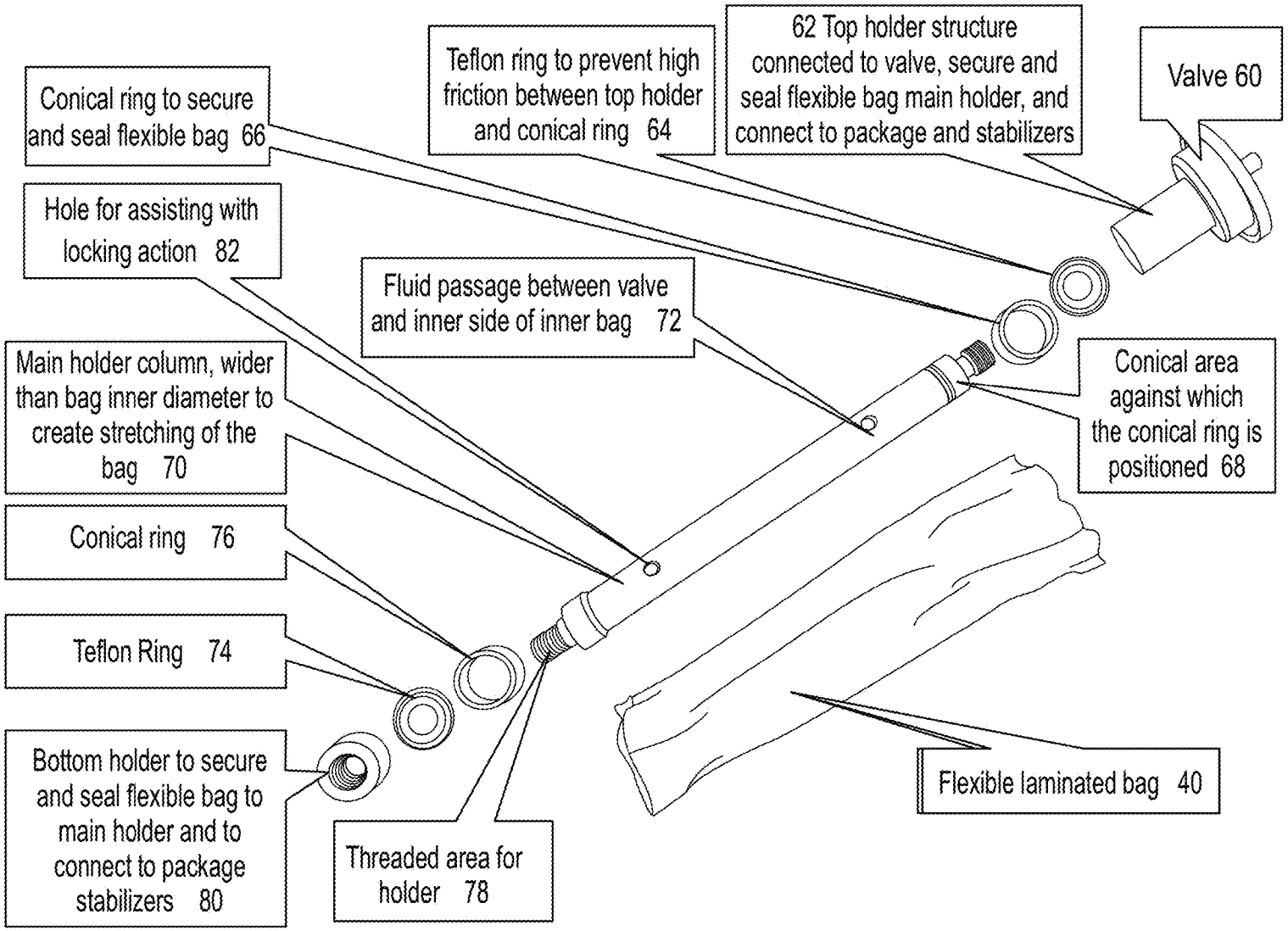
FIG. 7 is an exploded diagram of elements of a mechanical attachment bag assembly according to embodiments of the present invention.

Reference is now made to FIG. 7, which is an exploded diagram illustrating parts used in a dispensing structure according to the present embodiments. As shown in FIG. 7, the bag holder comprises a dispensing valve 60, an upper holding structure 62, below the valve 60, a first Teflon ring 64, an upper conical ring 66, and an upper conical area 68 on the anchor or main holder column 70. A fluid passage 72 reaches from the valve 60 to the region inside the inner bag. The flexible laminated bag 40 is shown to the side of the column for illustrative purposes.

At the lower end, the holding structure repeats itself with a second Teflon ring 74, a lower conical ring 76, and a lower conical area 78 on the anchor or main holder column 70. Bottom holder 80 secures and seals the bag to the conical ring arrangement. Hole 82 assists with the locking arrangements of the bag 40.

In greater detail the valve 60 may contrast with existing valves in that all valves that are currently used are made of a standard dispensing mechanism, namely a spring, rubber gasket, and several plastic parts, surrounded by a metal plate that is used to connect with the canister and create a sealed pressure canister. The present embodiments by contrast are propellant free and thus such a metal plate is not required. Instead, the dispensing mechanism can be held by a plastic part or parts, thus making the assembly cost effective and better for recycling. Indeed the package may be virtually metal free. In a particular embodiment, the only metal part is a single spring in the dispensing mechanism, which currently is made of metal. The use of plastic may generally ease production and improve or aid in improving the outer appearance of the dispensing device. The valve 60 is connected to connecting parts of the top holder structure 62. The valve may be connected to the bag by heat welding (as is done today with regular BOV), or using glue, or mechanically, etc. The mechanical attachment may involve placing the valve spring in the anchoring column and attaching the column to the valve mounting cup. The valve may be a standard 1" valve, a standard 20 mm valve or a dosage valve or any other kind of valve. The valve may have a metal mounting cup or may be entirely plastic.

Figure 8D:
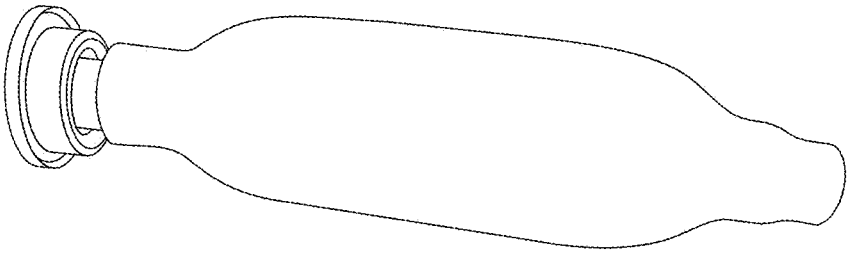
FIGS. 8A-8D show an exemplary inner bag assembly, in the empty state, showing the elastic sleeve, empty with the elastic sleeve mounted and in a filled state with the elastic sleeve, according to an embodiment of the present invention.

The top holder structure 62 is a part that connects and/or is connected to any one or more of the valve 60, the bag 40, the outer package (not shown) and outer package stabilizing parts. The top holder structure defines fluid passage 72 to transfer dispensable material from the valve 60 to the inner side of the bag 40 during filling mode, and from the inner side of the bag 40 to the valve 60 during dispensing mode. The top holder structure may include several individual parts e.g. 2-4 parts assembled together. For example, the top holder may comprise one or more parts for securing and sealing the flexible material of the bag to the main column assembly 70. The top holder structure may include metal ring 66 with an internal tapered shape of for example 7 degrees. The ring may be forced downwardly by a housing associated with the top holder structure that acts also as a securing nut. The securing of the nut may push the ring 66 against a conical part 68 of the main column 70, while the folded end of the flexible material is placed in between. The conical shape develops forces in parallel to the main column 70 as well as perpendicular forces. Both assist in securing and sealing the flexible material in order to create a sealed bag. Sealing may also be achieved by using the soft material characteristics of the bag to act as a sealant because during use the bag is squeezed and the bag material is able to fill all the voids and create a seal. A low friction Teflon ring 64 is placed between the holder housing and the metal ring to prevent rotation of the metal ring and the flexible material while the nut is being tightened. Furthermore, and as can be seen in FIG. 8D, the top holder housing and bottom housing also act as a sliding surface for the elastic sleeve when it elongates during the filling process, which it may do due to the Poisson Ratio. The ability for the ends to slide enables free floating of the elastic sleeve over the inner bag without any constraints. The surface for the top of the sleeve to slide on may be smooth or may be rough, say to prevent the sleeve from slipping off the bag. Furthermore, a stopper may be provided below the valve 60 to prevent the sleeve from generating forces on the valve during the stretching that takes place during filling of the bag. Further, the top holder 62 may also comprise a structure to connect the bag assembly to an outer package and package stabilizers or reinforcers of the device as described hereinbelow and illustrated in FIG. 11.

The bottom holder 80 is a part that connects the lower end of the bag 40, and may connect or be connected to the outer package as needed and may connect or be connected to other bags as desired. For example there is a modular option for multiple units, as described further herein. The bottom holder may be an assembly comprising several sub-components, for example 3-4 sub-components. As with the top holder 62, the bottom holder may comprise a part for securing and sealing the bag to the bag holder assembly. Connection to other bag assemblies may be achieved by an opening in the bottom end and a tube connection from the end to another bag assembly top or bottom assembly. Such a connection may be serial or parallel. The bag assembly may be connected to several bags as part of a multi bag structure and holding together mechanism, as discussed in greater detail below.

The anchor or main holder column 70 is a column that interconnects the top 62 and bottom 80 holders. The column may minimize axial stretching forces on the bag 40 to reduce risk of failure of the bag. The column may be round, but other shapes are envisioned. The column may be hollow, semi-hollow or solid. The column may have a diameter which is larger than the diameter of the elastic sleeve, in order to ensure that the elastic sleeve remains taut even when completely empty and that the last drop is dispensed under pressure. For example, the diameter of the column may be about 10-12 mm and the diameter of the sleeve about 8 mm.

The laminated bag 40 may be made of several layers for example—PE, PA and a barrier layer such as EVOH, PVDC, Metalized layers etc. The bag characteristics are designed to be flexible, for example to follow the sleeve curves, resist mechanical forces, provide a high barrier and also to provide an inner PE or PP layers as required by regulation. The laminated bag may be produced by a co-extrusion process or by a regular lamination process, involving gluing several sheets one on top of the other. The shape of the bag may be rectangular, leading to a single diameter bag and used with straight packages. Alternatively the bag may be provided in other shapes to provide multi diameter bags for example as needed when the outer package has a curved shape. As mentioned, the bag may be flexible, or may be flexible and stretchable.

A residual pressure e.g. between 1.5 and 3 bar, may be present on the bag at the sleeve even when the bag is empty. The residual pressure may serve to force all or almost all of the material out of the bag as it empties.

The column 70 may be used as a medium to transfer material being dispensed from the bag 40 to the valve 60. The column may also be used to store small amounts of gas or other materials if needed for a particular application. Alternatively and additionally, the central column 70 may be used to transfer material to the bag, e.g. for filling or dispensing. More particularly, the column has two diameters. The first is the locking area diameter in the region of the conical area 68. The diameter at 68 may be calculated from the bag diameter divided by three as described hereinabove. The other diameter is the diameter of the column between the locking areas as generally indicated by reference numeral 70. The diameter between the locking areas may be larger than the inner hole of the elastic sleeve in order to create preset pressure. The extent of the increase may be 30%, 50%, and even 100% of the inner diameter of the elastic sleeve. The diameters of the bottom and top holders 62 and 80 may be modified to fit the corresponding part of the column.

The rigid parts may be made out of plastic, or a combination of plastic and metal in the form of wire, ring, plate, rod, etc. The rigid column may be made of one piece or be made of several sections, for example telescoped sections, and the sections may be round or otherwise shaped, see FIG. 20 for examples. The column may contain a tension or compression spring to assist with extraction of material.

Figure 8C:
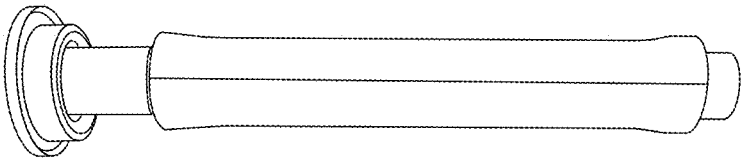
Figure 8B:
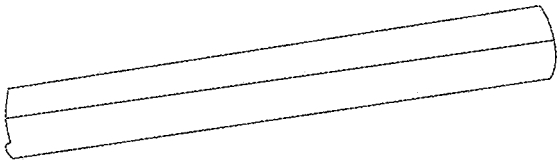
Figure 8A:
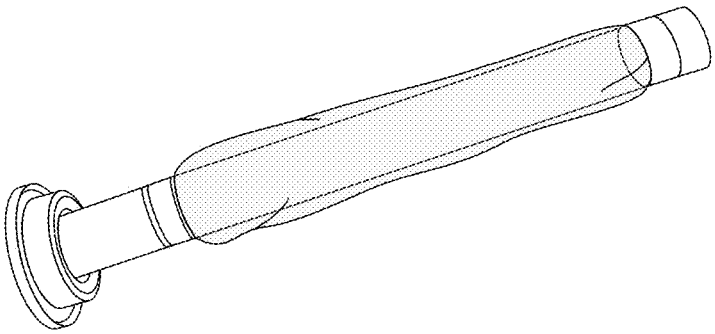

Reference is now made to FIGS. 8A to 8D which are additional photographs of the bag and holder. FIG. 8A shows the bag in the folded state mounted on the column. FIG. 8B shows the elastic sleeve. FIG. 8C shows the elastic sleeve fitted on the holder over the bag, and FIG. 8D shows the elastic sleeve forced into an expanded state due to pressurized filling of the bag with the material to be dispensed. It is noted that the top end of the holder has ridden up the sliding area of the top holder.

Figures 9A, 9B:
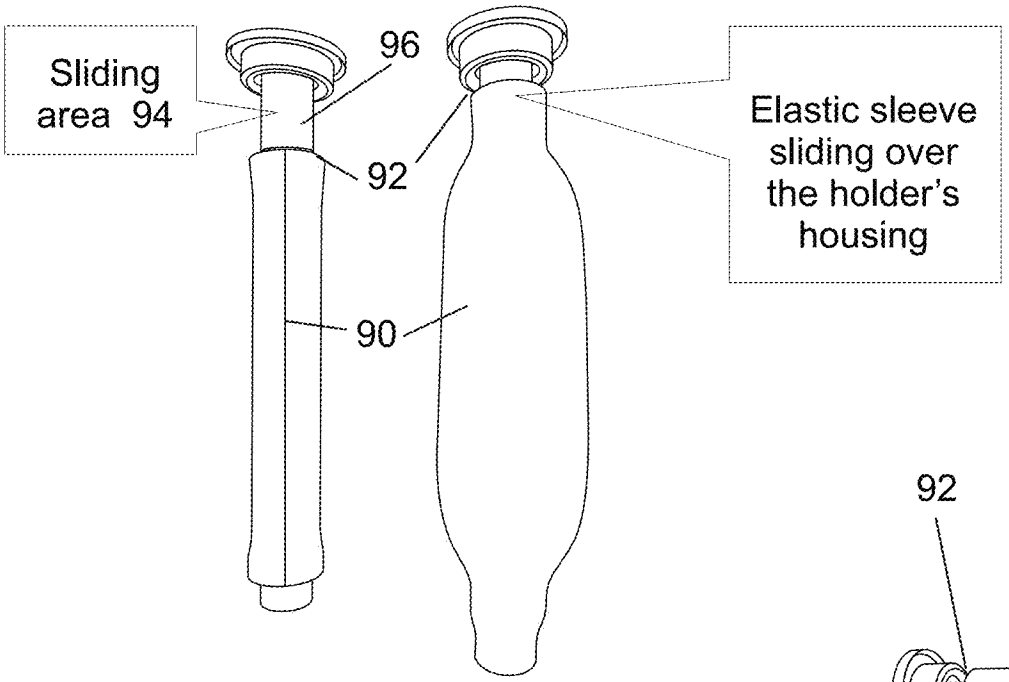
FIG. 9A shows an exemplary bag assembly and elastic sleeve in an empty state.
FIG. 9B shows the same bag assembly with elastic sleeve in a filled state.

FIGS. 9A and 9B are taken from a photograph of the sleeve 90 fitted over the bag in the dispenser mechanism. In FIG. 9A the bag is empty and in FIG. 9B the bag is full. Again, the top 92 of bag 90 is seen to ride up the sliding area 94 of the top holder 96.

Figure 10:
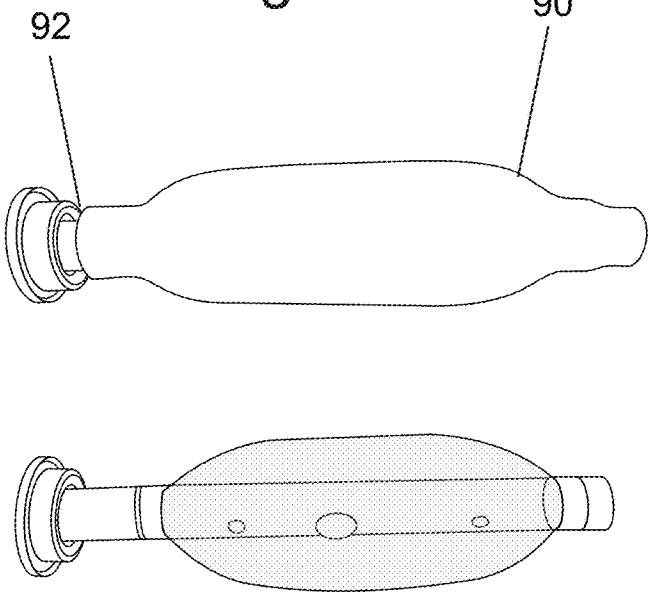
FIG. 10 is a photograph of an exemplary bag assembly with and without the elastic sleeve, both in filled states.

FIG. 10 is a photograph of the bag assembly in the filled state, with the elastic sleeve 92 mounted over the bag (top) and without the elastic sleeve (bottom).

Figure 11:
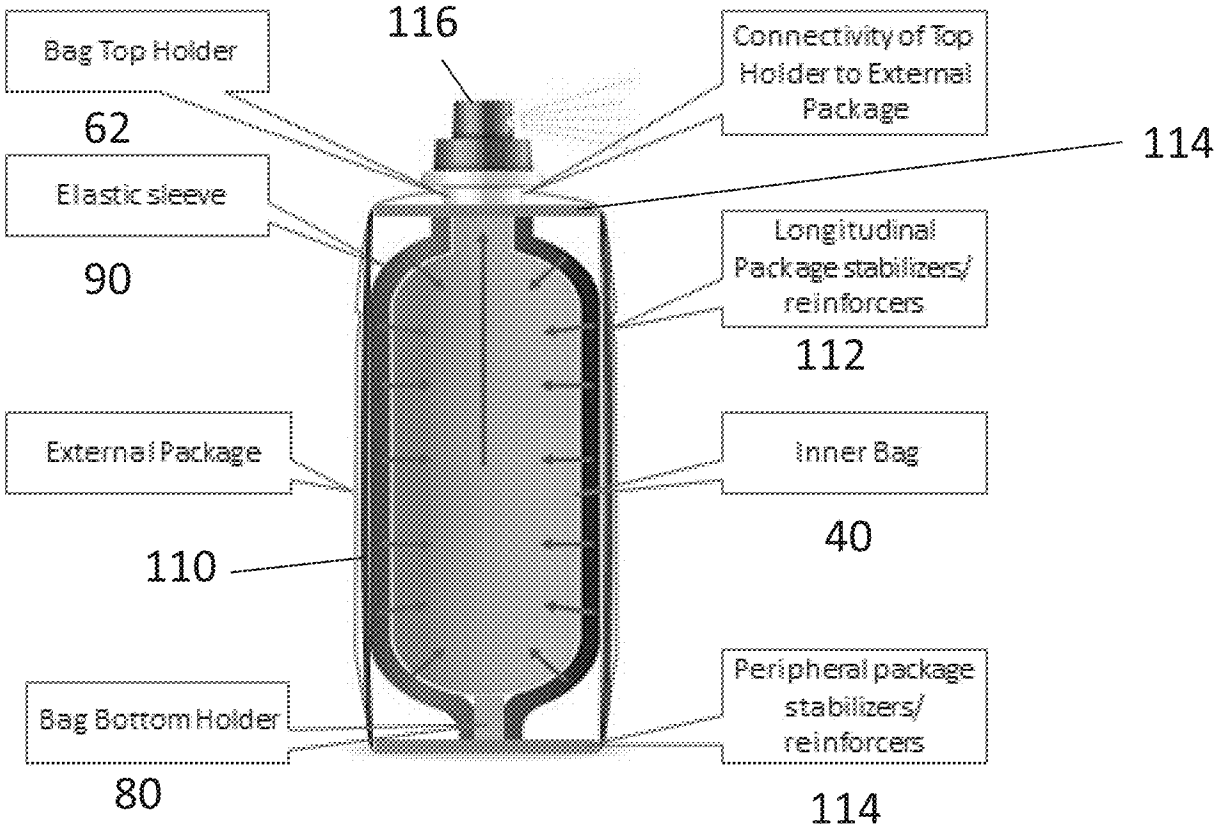
FIG. 11 is a simplified schematic diagram of a structure to connect an exemplary bag assembly to an outer package of the device.

FIG. 11 is a schematic cross-sectional illustration of the connection of the bag assembly to an outer package 110 of the device as aforementioned. Bag 40 is pressed inwardly by elastic sleeve 90. The bag is held between top holder 62 and bottom holder 80. The outer package 110 fits into the structure of the top holder and a valve interface 116 allows for easy operation of the valve by the user. The outer package includes package stabilizers or reinforcers 112, 114, that may be needed for soft and flexible packages. For example, top and bottom rigid plates 114 may assist in creating a steady package. Longitudinal reinforcements 112 may assist in retaining the package shape throughout use. The reinforcements may also assist in package resistance to impact. The reinforcement parts may be connected to the bag holders or be made as part of the holder or holders, and may be made of plastic material or other supportive materials, and the structure of the reinforcement elements may be designed according to package requirements.

Multi Chamber—In an optional embodiment of the invention, a modular assembly device comprising multiple inner bag assemblies is provided. In such an embodiment, the device may further comprise an additional bag or bags. Additional bag/s may be attached or added to the bag assembly, for example by connecting or interconnecting the bags via an opening in the bottom of the bag holder assembly. The plastic part or parts connecting or connected to the bottom end of the inner bag, may connect or be connected to additional mounted sleeves on bags as desired, for example in a chain, i.e. a series or string of bags or parallel.

In some embodiments, a modular device may comprise more than one assembly or 'chamber', and such a construction is described under the heading "Multiple Chamber Devices" in PCT application publication number WO2014/111939 of the same Applicant and incorporated herein by reference. Therein are described examples of two chambers, three chambers, and more than three chambers, and the embodiments described therein may be modified by addition of the circumferentially folded inner bags of the present embodiments. As applied to the present embodiments, each chamber or additional assembly of the present device may comprise one or more Z-folded inner bags, with an elastic sleeve mounted over it, and attached to a bag holder assembly as described herein. Each chamber may be attached to another or other chambers via a disk, to which the bag assembly may be attached, e.g. by attachment to the disk edges or stretching of the elastic portion around the disk/s.

In some embodiments, a modular device includes one or more valve/s connecting between multiple chambers.

In some embodiments, different chambers may have different pressures, e.g. due to different chamber shapes. In some embodiments, elastic portions within different chambers may have different properties, such as a different elastic modulus, or a different thickness, for example, and thus providing different pressures. In some embodiments, multiple chambers may dispense at different rates, e.g. due to different chamber pressures.

In some embodiments, a multiple chamber device includes more than one outlet, optionally facilitating concurrent dispensing from more than one chamber. Optionally, multiple chambers may have different geometries, such as different sizes or shapes. Optionally, chambers and/or bags are attached by tubing.

In some embodiments, multiple chambers dispense sequentially. In some embodiments, multiple chambers dispense concurrently.

The bag may have a connecting hole and attachment mechanism to connect several sleeves in serial or parallel modes. The connectivity hole may be pressure regulated or not.

In some embodiments, multiple chambers do not share rigid portions, but are separate modules, for example, attached by tubing. For example each portion may have its own rigid portions.

Returning to FIG. 11, and some embodiments of the invention may comprise an external container or package 110 which contains the bag assembly and elastic sleeve. The package 110 may be cylindrical or non-cylindrical. The package may have any shape, as the component parts of the device according to the present invention do not necessitate or require a cylindrical or other specific container shape due to safety concerns, since the device according to the invention does not hold a pressurized propellant and there is therefore no pressure on the external package. In addition, for the same reason, the package may be made of different materials, e.g. rigid or flexible plastic, carton, glass, etc. or combinations thereof, and in a variety of different shapes, for marketing/advertising advantage or to simplify and reduce costs of packaging, packing and handling.

In some embodiments of the invention, the bag assembly may be connected to the external package 110 by addition of connecting parts. As shown in FIG. 11, the shape of the top holder 62 attaches to the external package 110, but in other embodiments connecting parts may be provided. A connecting part or parts may be separate to the bag assembly. In an alternative embodiment, the connecting part or parts may comprise part of the bag assembly. The package may provide a support structure for example for holding the filled bag and sleeve assembly and may optionally also be self-supporting.

According to some embodiments of the invention, the connecting parts are made of rigid plastic and are placed at the top and bottom of the package. Exemplary connecting parts may be connected to the package, for example by heat, adhesive, mechanically, and so on. In the same way, the connecting parts may be connected to the bag assembly, for example to the valve area and/or bottom end of the bag assembly.

Figure 12:
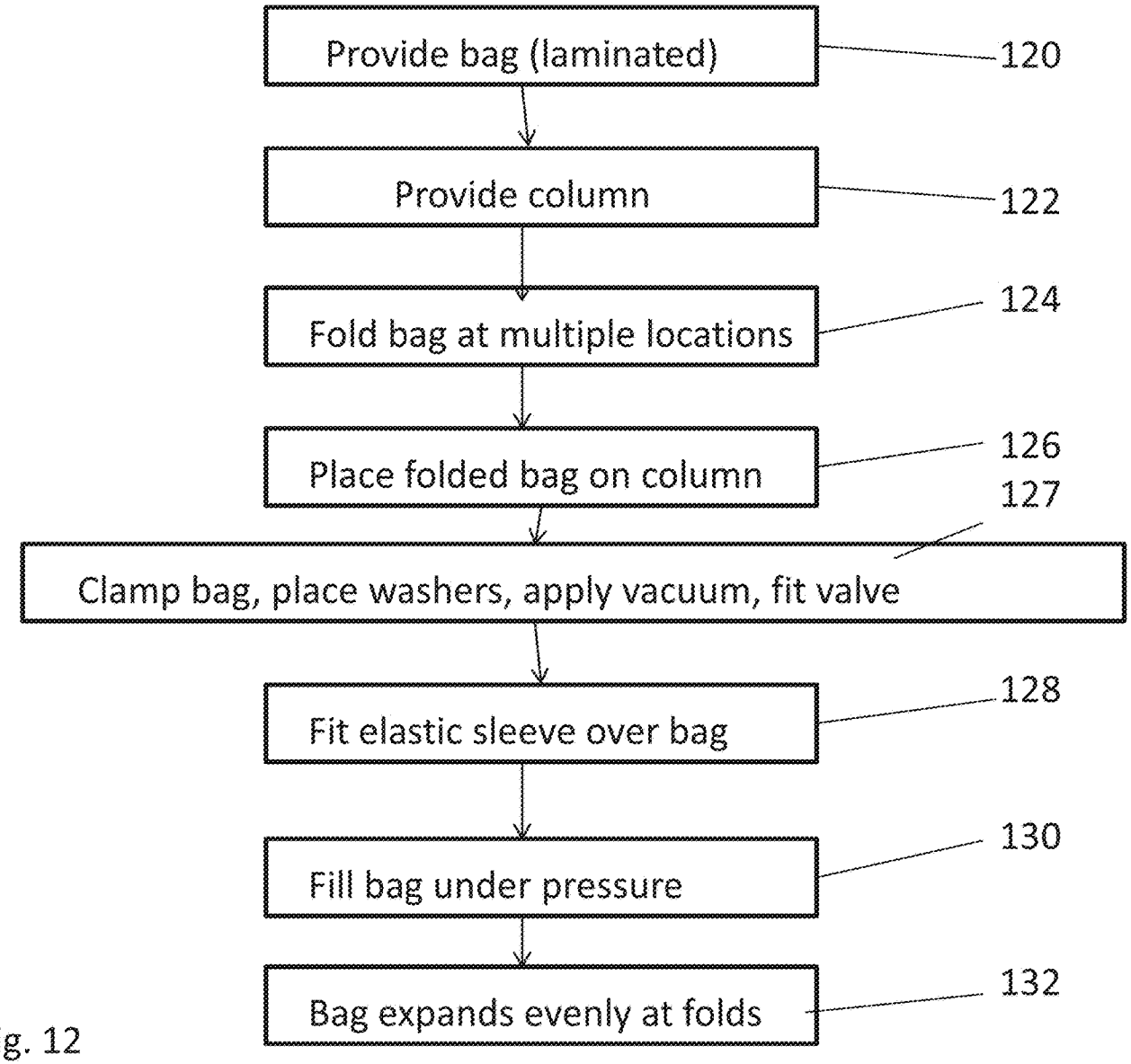
FIG. 12 is a simplified flow chart illustrating a process of assembly of an exemplary bag and elastic sleeve according to embodiments of the present invention.

Reference is now made to FIG. 12, which illustrates a method of manufacturing a fluid dispenser according to the present embodiments. The manufacturing process comprises initially providing—120—an inner bag of a given height and circumference. Typically, but not necessarily, the bag is laminated with layers that include an EVOH barrier layer, among other options, as discussed herein.

An anchoring column is provided—122, which is long enough to extend between the upper and lower ends of the bag. The circumference, or outer boundary, of the column may be smaller than the bag circumference, and an upper end of the column may be connected to a dispensing valve.

The bag is then folded—124—at multiple folding locations around the circumference, to reduce the bag circumference to that of the column so that the bag fits on the column. The number of folding locations may be four, five, six, seven, eight, nine, ten, eleven, twelve, thirteen, fourteen etc. The folds may be three layers (z folds) or more, as discussed above with respect to FIG. 5.

The folded bag is then placed—126—on the column, and may be clamped in position. Washers may be placed—127—between the clamps and the column, a vacuum may be applied to the bag and the valve fitted thereto, and then the elastic sleeve is fitted —128—over the folded bag on the column. Then as the bag is filled under pressure —130—, the bag unfolds—132—under the sleeve by opening the different folds together, and expanding evenly under the sleeve.

Figure 13:
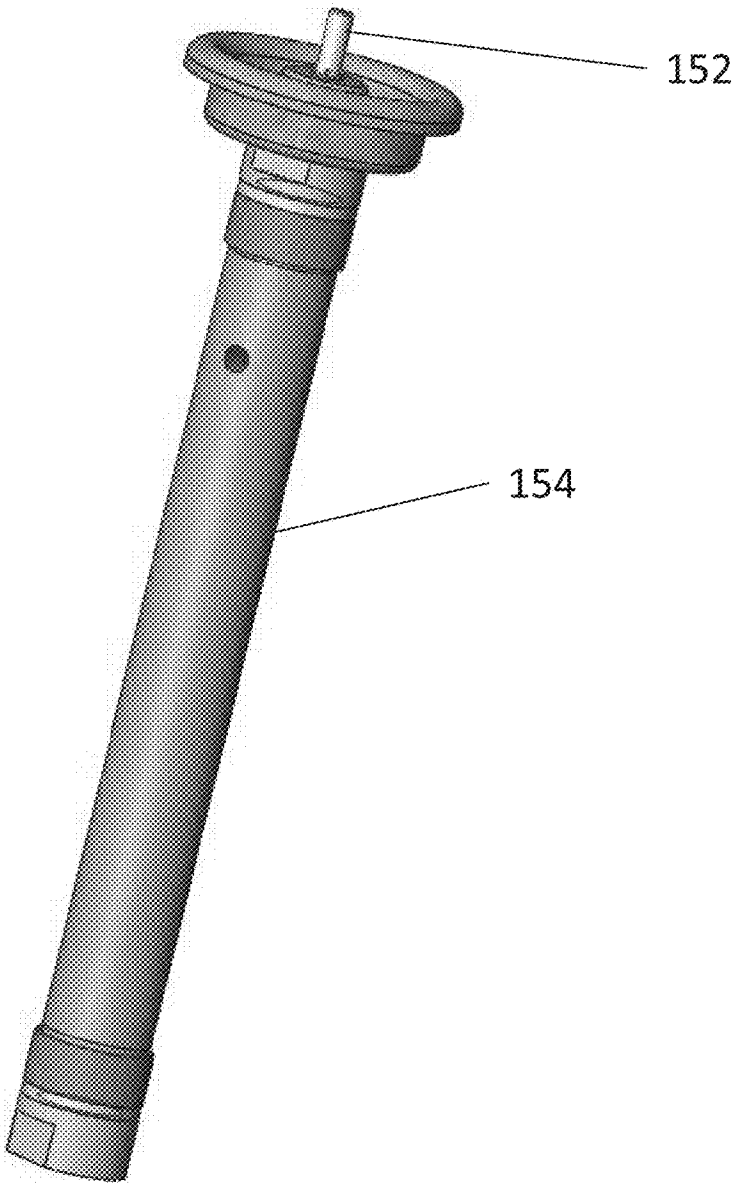
FIG. 13 is a simplified diagram showing an anchoring rod according to an optional further embodiments which adds a Spring Housing for the valve spring as part of the anchoring rod, and the anchoring rod being mechanically attached to the valve Mounting Cup instead of the spring housing, according to an embodiment of the present invention.

Reference is now made to FIG. 13, which is a simplified diagram showing an anchoring column or rod according to an additional embodiment of the present invention, which provides an internal a Spring Housing to house the valve spring and is mechanically attached to the valve Mounting Cup, instead of to the Spring Housing as in conventional use today. The column may have a hollow pipe which is mechanically continuous with the pipe of the aerosol valve, according to an embodiment of the present invention.

Figure 14:
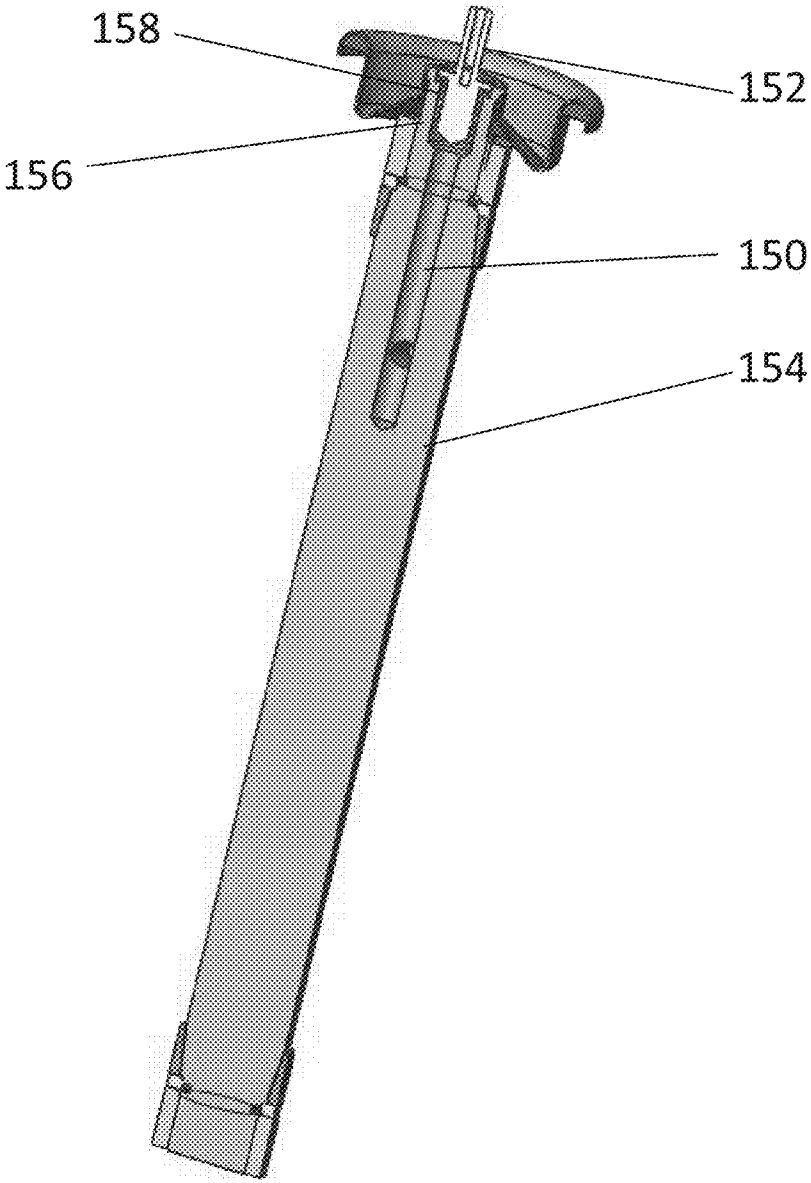
FIG. 14 is a longitudinal cross section of the valve and rod of FIG. 13.

FIG. 14 is a longitudinal cross section of the valve of FIG. 13.

Figure 15:
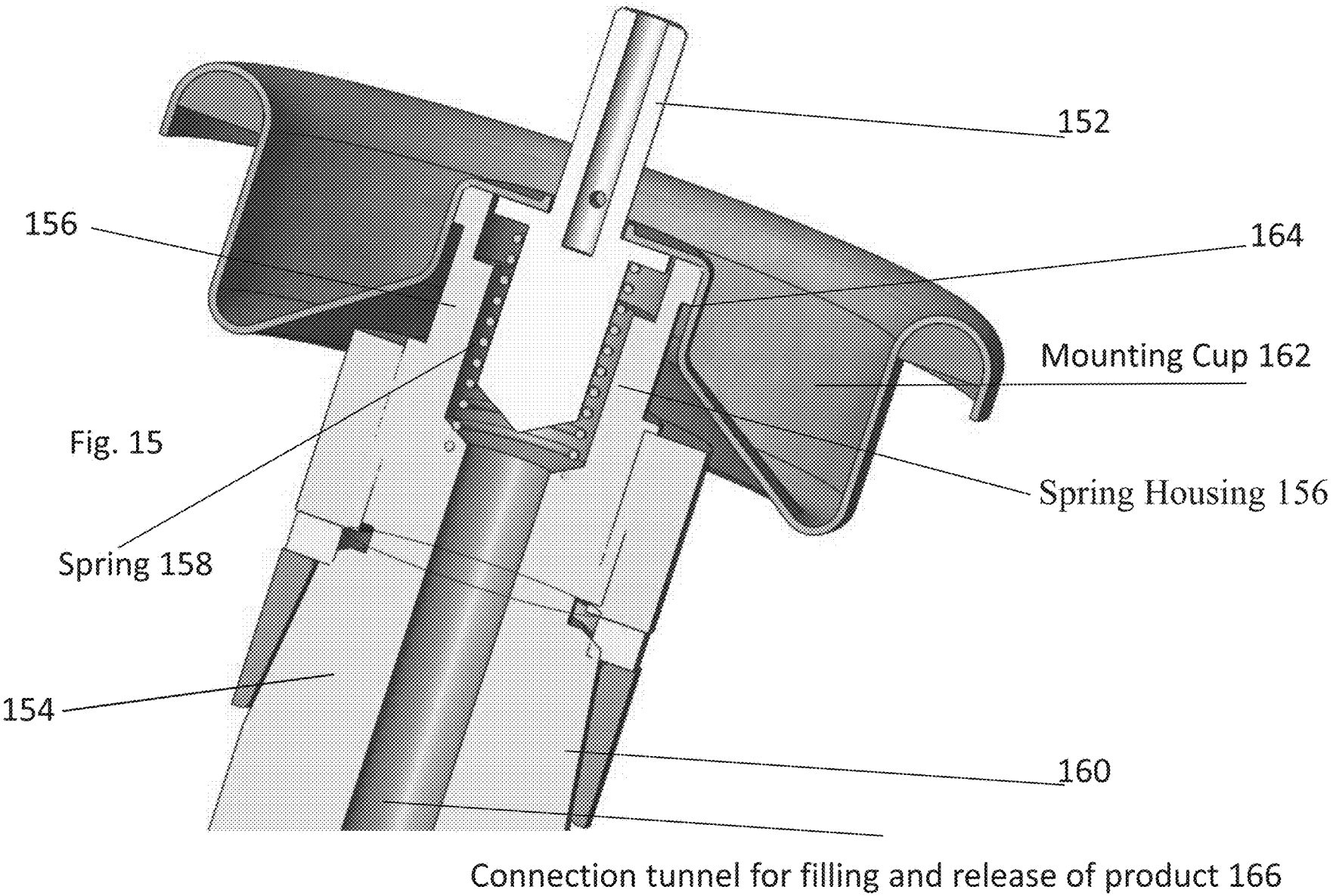
FIG. 15 is a cross-sectional view of a mechanical connection between the anchoring rod and the valve comprising a Spring Housing for the valve spring, in which the anchoring rod is mechanically attached to the valve Mounting Cup, instead of to the spring housing as in the embodiment of FIG. 13.

FIG. 15 is a cross-sectional view of the mechanical connection between the anchoring rod and the valve outlet pipe in a version of the embodiment of FIG. 12.

Figure 16:
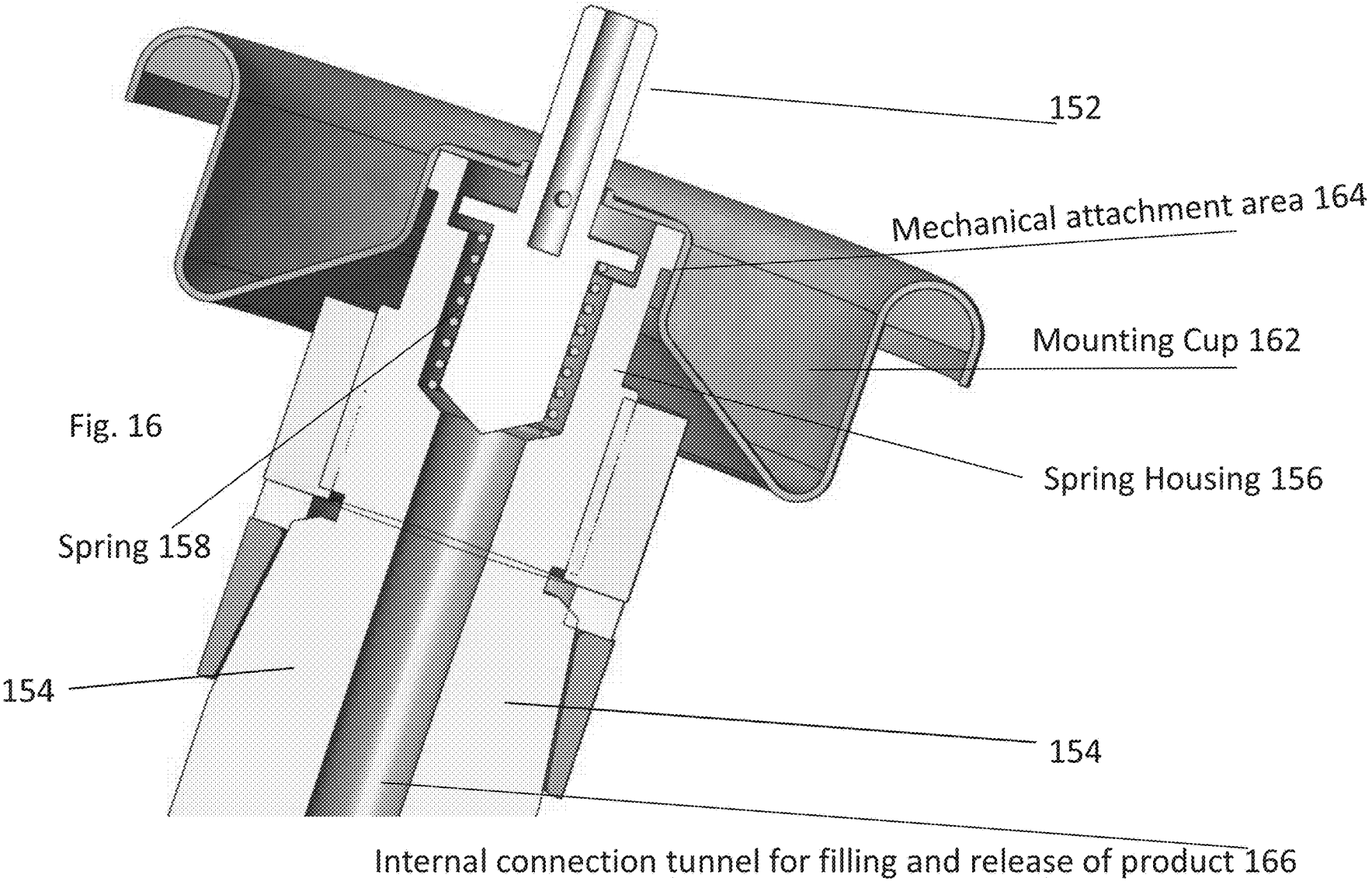
FIG. 16 is the same cross-sectional view as in FIG. 15 but after the valve has been depressed (release mode)

FIG. 16 is the same cross-sectional view as in FIG. 15 but after the valve has been depressed, in release mode.

The embodiment of FIGS. 13-16 may relate to a direct mechanical connection between the pressurized bag and jacket and the dispensing valve. The anchoring rod 154 according to an optional further embodiment includes an intrinsic spring housing 156 (FIGS. 14, 15, 16) for the valve spring 158 (FIGS. 14, 15, 16) as part of the anchoring rod 154. The anchoring rod 154 is then mechanically attached to the valve Mounting Cup 162 (FIGS. 15 and 16) through the spring housing 156. The mechanical connection is at mechanical connection area 164 (FIGS. 15 and 16). The dispensing valve may be a standard aerosol 20 mm dispensing valve or any other valve. The present embodiments may save on parts and processes and thereby improve safety and reliability, thereby reducing costs.

Pipe 150 (FIG. 14) of aerosol valve 152 extends into a cavity of anchoring rod 154, and serves as an outlet pipe, so that material from the bag is delivered directly to the valve via connection tunnel 166 (FIG. 16).

For example the end of the rod inside the inner bag, that is the anchoring column, can be made with a cavity to host the valve's spring which in the current art is hosted by a separate spring housing.

In the present embodiment, the upper anchoring point may be outside of the location of the spring.

In an alternative embodiment, the anchoring column is welded onto the rhombus of the valve itself. The top of the column may have an internal pocket to which the rhombus is welded, and then the outer part of the column forms the upper anchoring point and the bag is welded on the outside.

Using the above embodiments, the anchoring column is directly connected to the spring housing.

In the above embodiments, a cone and washer arrangement, specifically two cones with a washer in between, lock the bag very effectively. However in order to have sufficient mechanical strength, the parts are required to include at least some metal, otherwise the locking parts are likely to break. For efficiency of manufacture it is preferable to use plastic but translating the above embodiments directly into an all plastic design leaves the design vulnerable to breakage.

Reference is now made to FIGS. 17 to 21 which illustrate a design which uses heat welding of the laminate bag to the rod under pressure to attach the bag to the rod. The welding may be of polyethylene on polyethylene or polypropylene on polypropylene or other suitable combinations where heat welding is effective. The welding is not only in order to anchor the two ends of the bag but also may ensure that the pressurized fluid or vapors do not escape. In particular, the aerosol can may be left on a warehouse shelf for a considerable amount of time before it is used and vapors tend to diffuse through a membrane over time so that the weld should not provide an easier avenue for particle diffusion than any other part of the design. Thus the present embodiments may provide a weld with barrier capabilities, as will be explained hereinbelow, as well as for locking or securing or anchoring the bag.

The combination of anchoring and a barrier may be provided by first welding the bag to a shaped surface and then carrying out plastic injection in an overmolding process.

The barrier to gas diffusion may be achieved by making a broad weld, say of the order of 10 mm. Generally an aerosol can may be loaded with a pressure of 6 or 7 atmospheres, and thus the weld may not only be relatively broad but may be along a shaped surface, say a square wave shaped surface to make the diffusion path longer and thus the diffusion rate slower. As discussed, once welded, the weld may be sealed in with an overmolding of plastic.

Figure 17:
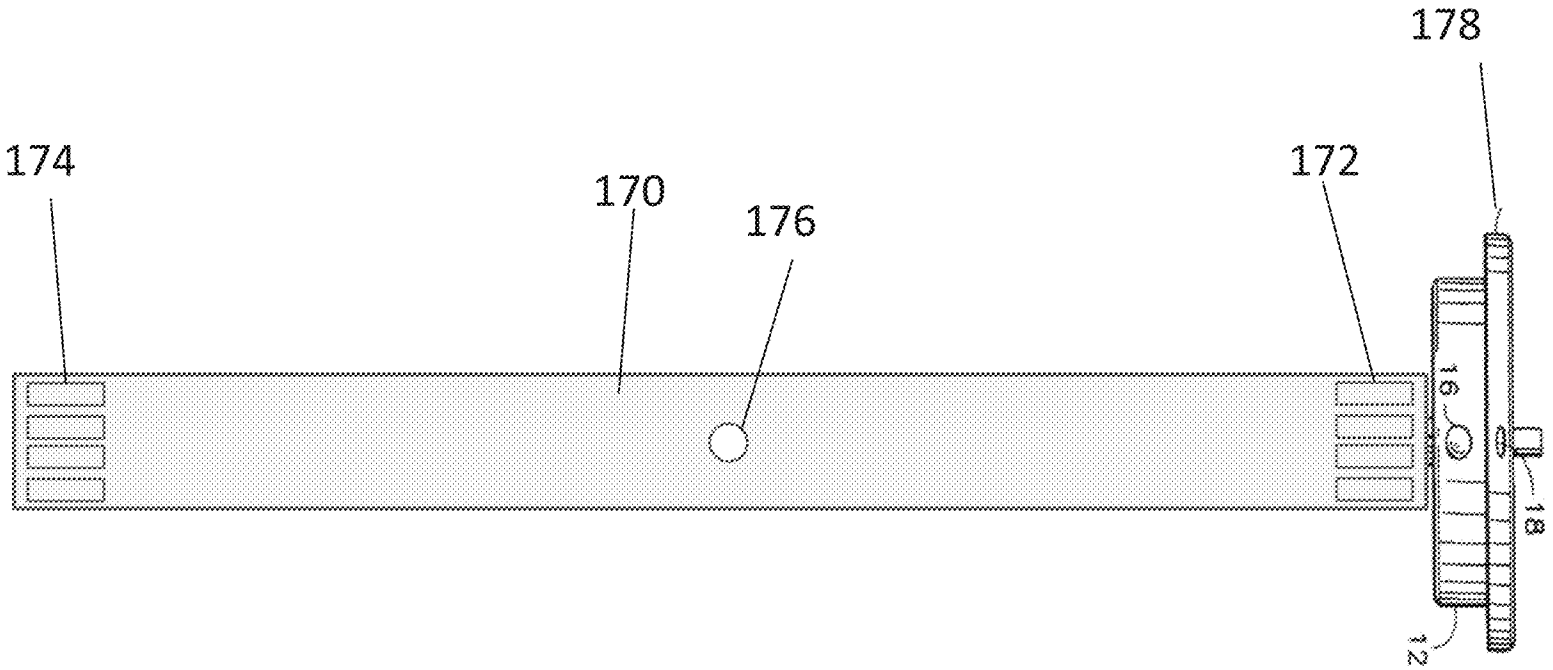
FIG. 17 is a simplified diagram showing an anchor column with welding sites according to an embodiment of the present invention.

FIG. 17 illustrates an anchoring column 170 with upper 172 and lower 174 anchoring sites for anchoring a bag. Opening 176 in the anchoring column connects the interior of the bag with the valve 178 at the opening of the aerosol can. The bag is placed between the upper and lower welding sites, and the anchoring column may be hollow or partly hollow and may have any suitable cross section, for example rounded or flattened, or kite shaped or the like. The shape may be applicable just to the welding areas or all along the column.

Figure 18:
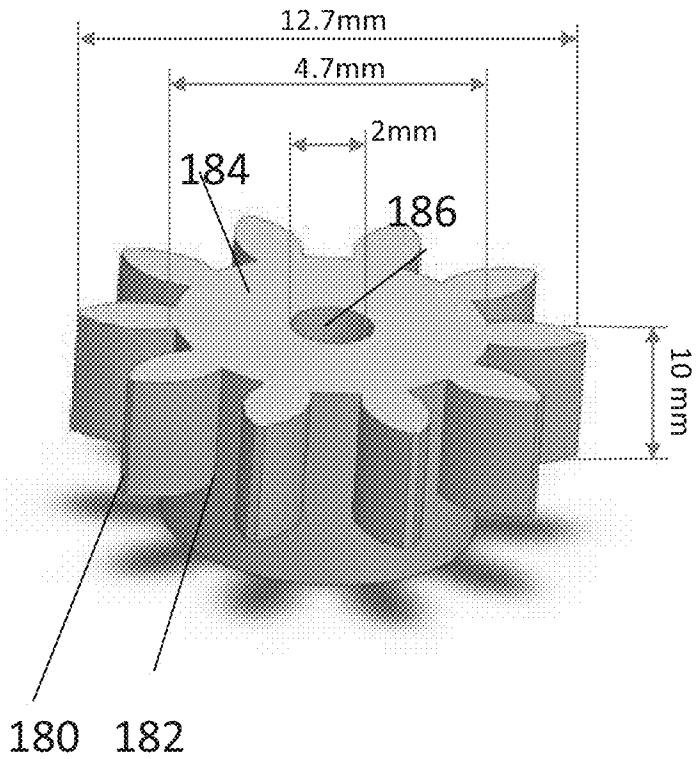
FIG. 18 is a simplified diagram showing a surface of the anchor column at the welding site of FIG. 17.
Figure 19:
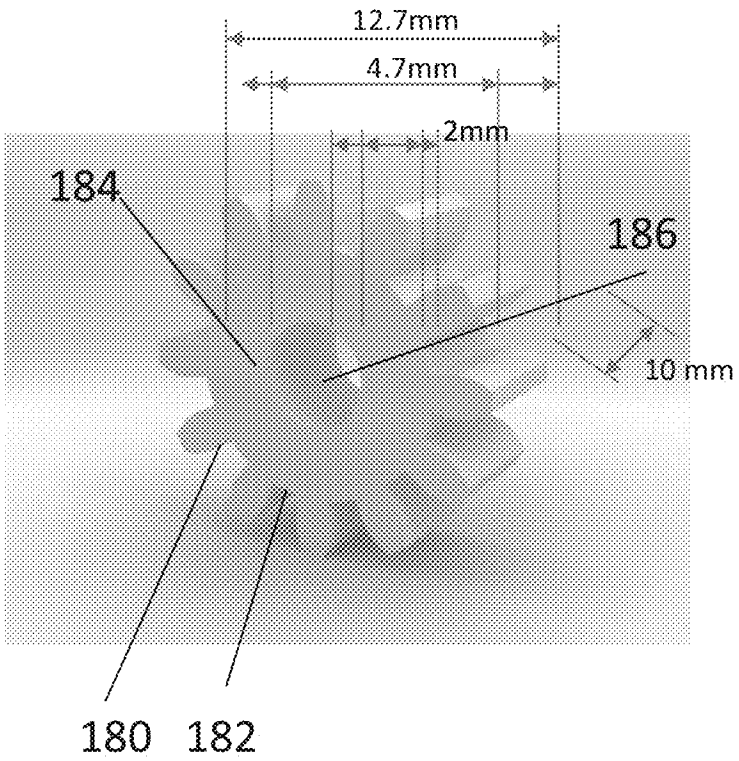
FIG. 19 shows a variation of the welding site of FIG. 18.

FIGS. 18 and 19 illustrate two examples of anchoring sites for the anchoring column of FIG. 17. The version in FIG. 18 is for a 40 mm radius and that in FIG. 19 is for a 50 mm radius. In both cases cog-style teeth 180 interspersed with troughs 182 surround a central ring 184, with a hollow 186 in the middle for fluid communication. Exemplary sizes are shown in the drawing for designs to withstand pressures of 6 to 7 atmospheres. The version in FIG. 18 has fifteen teeth for thirty folds in the weld. The version in FIG. 19 has 18 teeth for thirty six folds in the weld.

Figure 20:
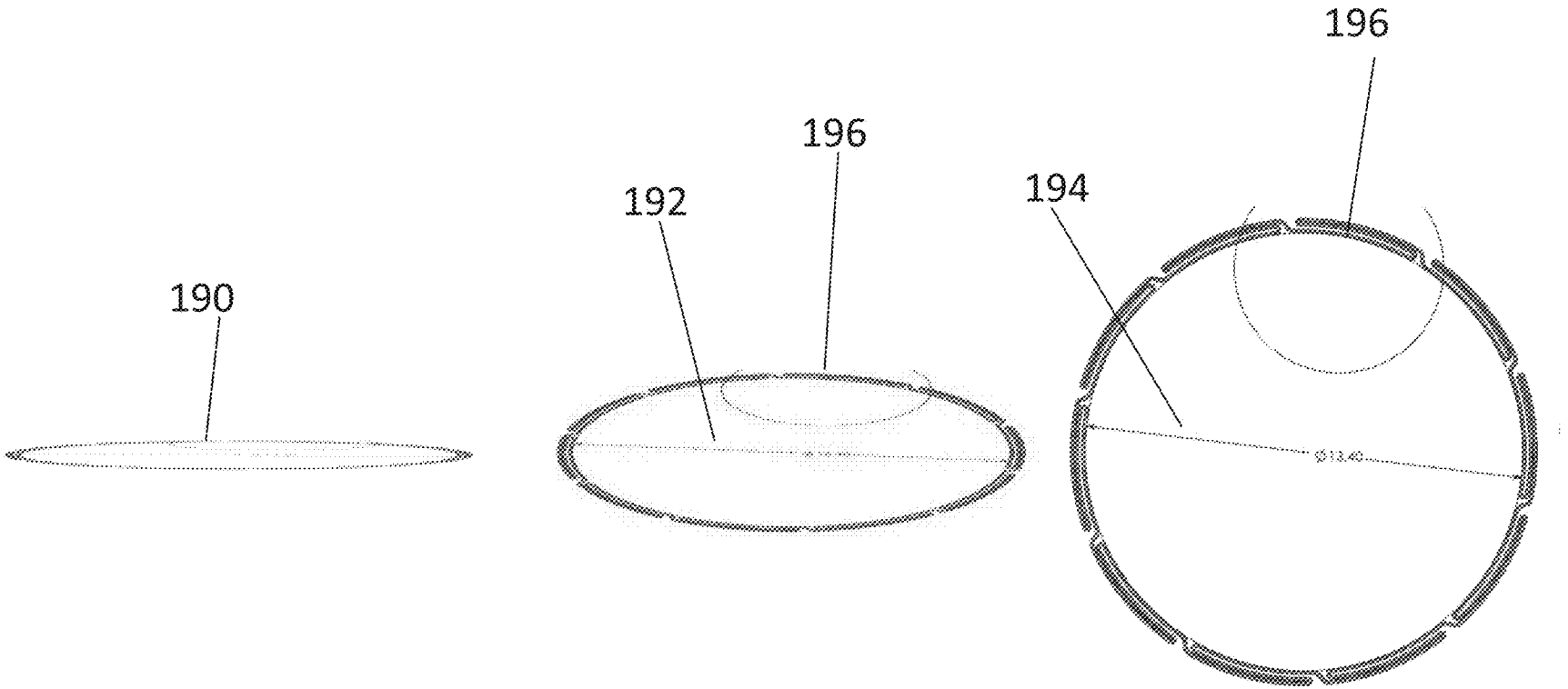
FIG. 20 shows a series of different cross-sections of the anchoring column.

Flat 190, oval or rhombus 192 and round 194 cross-sections for anchoring column 170 are shown in FIG. 20. In each case a bag 196 is folded around the column.

Figure 21:
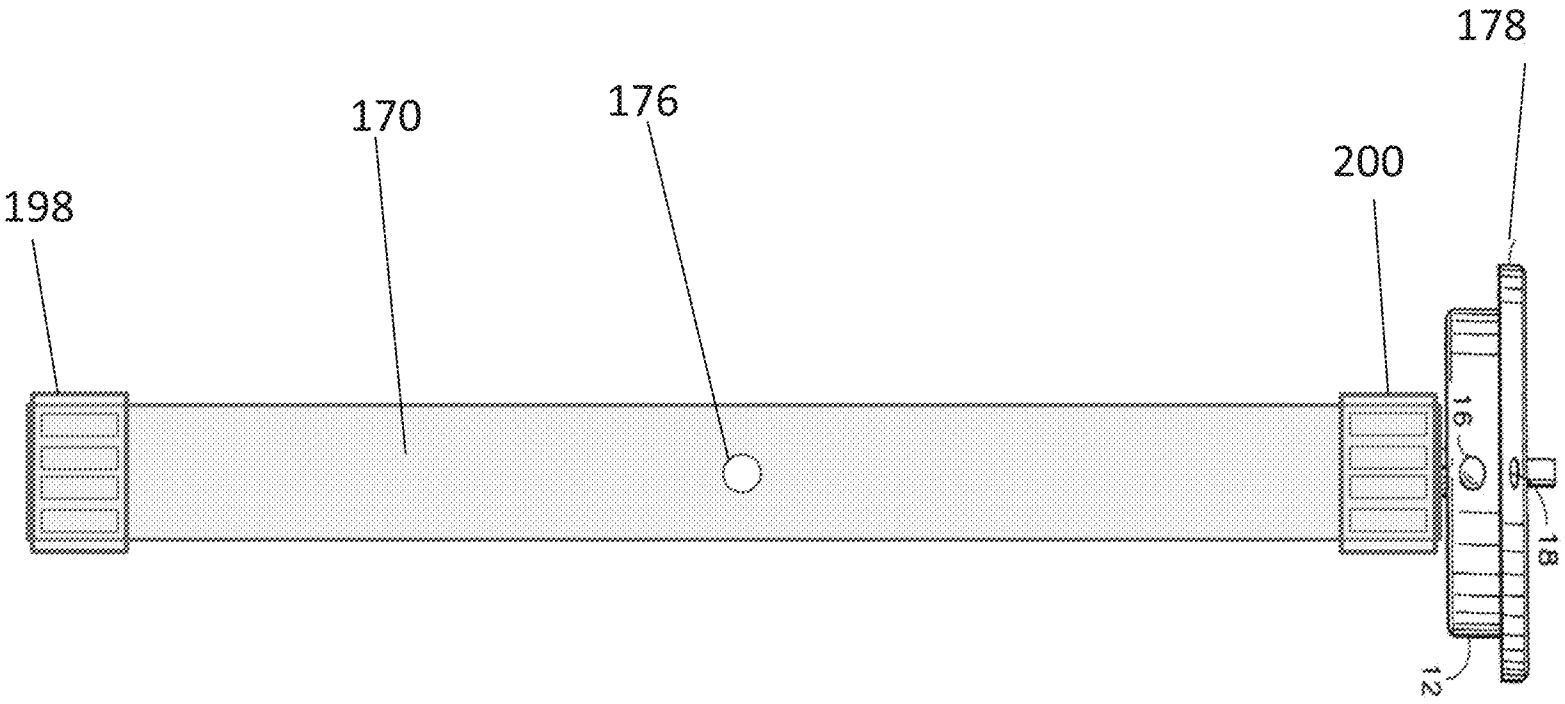
FIG. 21 shows overmolding or other mechanical method (such as a metal ring, reinforced plastic ring) to strengthen the weld site of FIG. 17.

Referring now to FIG. 21, hard molded rings 198 and 200 are injected over the welding sites to add mechanical strength and barrier capabilities to the weld. As an alternative to being injection molded over the weld, the rings could be themselves welded. The weld could be conventional heat welding or ultrasonic welding and mechanically fitted or combined or not.

The anchoring column may include an internal chamber filled with other material or agent.

It is expected that during the life of a patent maturing from this application many relevant dispensing mechanisms will be developed and the scope of the term "dispensing mechanism" is intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A fluid dispensing mechanism for a fluid dispensing device, comprising an elastic sleeve surrounding a bag for filling with fluid for dispensing, the bag having a circumference and being folded with overlapping folds at a plurality of folding locations around said circumference, thereby to unfold evenly under said sleeve during a filling process of pressurized filling of said bag with fluid, the mechanism further comprising an anchoring column, said bag being folded around said anchoring column, said folded bag having an upper end and a lower end, and both said lower end and said upper end being fixedly attached to said anchoring column, said attachment being via one member of the group comprising a heat weld, a screw cap, an overmolded cap and glue.

2. The mechanism of claim 1, wherein said plurality of folding locations are at regular intervals around said bag circumference.

3. The mechanism of claim 2, wherein said plurality of folding locations are symmetrically arranged around said circumference.

4. The mechanism of claim 3, wherein folds at said folding locations are three layer folds or more.

5. The mechanism of claim 1, wherein said sleeve has an upper end, said sleeve ends being slidable along the bag and the housing of a holding part of said anchoring column, said upper holding part being connected to a user-operable valve for dispensing said fluid.

6. The mechanism of claim 1, wherein said folded bag comprises a plurality of laminated or co-extruded layers.

7. The mechanism of claim 1, wherein said elastic sleeve is of sufficient strength to press said bag against said column until said bag is substantially emptied of said fluid to be dispensed.

8. The mechanism of claim 1, said bag being folded around said anchoring column, and the anchoring column being axially aligned with an outlet pipe to an aerosol dispensing valve.

9. The mechanism of claim 8, wherein said anchoring column comprises a reservoir of other material or agent.

10. The mechanism of claim 8, wherein said bag is heat welded to said anchoring column.

11. The mechanism of claim 10, wherein said bag is heat welded at two anchoring locations, the anchoring locations being one member of the group comprising: shaped with teeth and smooth.

12. The mechanism of claim 10, wherein said bag is heat welded at two anchoring locations, the anchoring locations having an outer shape being one member of the group comprising: rounded, flattened, oval shaped, diamond shaped, and rhombic.

13. The mechanism of claim 1, having an outlet valve operated by a spring and wherein the spring is housed in the anchoring column.

14. The mechanism of claim 1, comprising a plurality of bags.

15. A method of manufacturing a fluid dispenser comprising:

providing a bag having a height and a bag circumference;

providing an anchoring column having a column circumference smaller than said un-folded bag circumference;

connecting an upper end of said column to a dispensing valve;

folding said bag with overlapping folds at a plurality of folding locations to reduce said bag circumference to substantially equal said column circumference;

placing said bag on said column;

clamping said folded bag at said upper end and at said lower end under upper and lower holders respectively; and fitting an elastic sleeve over said folded bag, such that on filling said bag, said bag unfolds under said sleeve evenly by opening folds at said plurality of folding locations.

16. The method of claim 15, further comprising filling said bag and causing said bag to unfold under said sleeve by opening each of said plurality of folds.

17. The method of claim 15, comprising heat welding said folded bag at said upper end and at said lower end.

18. The method of claim 15, comprising placing washers between said column and said upper and lower holders respectively.

19. The method of claim 15, wherein said bag is a laminated or co-extruded bag.

20. The method of claim 15, comprising providing at least four folding locations.

21. The method of claim 15, comprising folding said bag into three layers or more at each of said folding locations.

* * * * *